US011831076B2

(12) United States Patent
Yoshikawa

(10) Patent No.: US 11,831,076 B2
(45) Date of Patent: Nov. 28, 2023

(54) ANTENNA, WIRELESS COMMUNICATION MODULE, AND WIRELESS COMMUNICATION DEVICE

(71) Applicant: KYOCERA Corporation, Kyoto (JP)

(72) Inventor: Hiromichi Yoshikawa, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 385 days.

(21) Appl. No.: 17/288,914

(22) PCT Filed: Oct. 25, 2019

(86) PCT No.: PCT/JP2019/042058
§ 371 (c)(1),
(2) Date: Apr. 27, 2021

(87) PCT Pub. No.: WO2020/090691
PCT Pub. Date: May 7, 2020

(65) Prior Publication Data

US 2021/0399435 A1 Dec. 23, 2021

(30) Foreign Application Priority Data

Oct. 31, 2018 (JP) ..... 2018-206002

(51) Int. Cl.
*H01Q 21/00* (2006.01)
*H01Q 13/08* (2006.01)
*H01Q 1/48* (2006.01)

(52) U.S. Cl.
CPC ..... *H01Q 21/0006* (2013.01); *H01Q 13/08* (2013.01); *H01Q 1/48* (2013.01)

(58) Field of Classification Search
CPC ..... H01Q 21/0006; H01Q 13/08; H01Q 1/48; H01Q 1/38; H01Q 1/521; H01Q 9/0442;
(Continued)

(56) References Cited

U.S. PATENT DOCUMENTS 4,827,271 A 5/1989 Berneking et al.
4,924,236 A * 5/1990 Schuss ..... H01Q 9/0442 343/859

(Continued)

FOREIGN PATENT DOCUMENTS

CN 105210232 A 12/2015
EP 2940795 A1 4/2015
JP 2017504274 A 2/2017

*Primary Examiner* — Seung H Lee
(74) *Attorney, Agent, or Firm* — HAUPTMAN HAM, LLP

(57) ABSTRACT

An antenna includes first and second antenna elements and first and second couplers. The first antenna element includes a first radiation conductor and a first feeder line. The second antenna element includes a second radiation conductor and a second feeder line. The second feeder line is coupled to the first feeder line such that a first component, which is a capacitance component or an inductance component, is dominant. The first coupler couples the first and second feeder lines such that a second component is dominant. The first radiation conductor and the second radiation conductor are arranged at an interval of ½ or less of a resonance wavelength. The second radiation conductor is coupled to the first radiation conductor with a first coupling method in which a capacitive coupling or a magnetic field coupling is dominant. The second coupler couples the first and second radiation conductors with a second coupling method.

20 Claims, 22 Drawing Sheets

(58) Field of Classification Search
CPC ..... H01Q 9/42; H01Q 5/40; H01Q 21/06; H01Q 21/28
See application file for complete search history.

(56) References Cited

U.S. PATENT DOCUMENTS

| | | | | |
|---|---|---|---|---|
| 9,214,730 | B2 * | 12/2015 | Ley | H01Q 9/0407 |
| 10,033,088 | B2 | 7/2018 | Zhang et al. | |
| 2006/0044196 | A1 | 3/2006 | Grant et al. | |
| 2010/0159857 | A1 | 6/2010 | Kling et al. | |
| 2012/0306718 | A1 | 12/2012 | Koyanagi et al. | |
| 2013/0057438 | A1 | 3/2013 | Satou et al. | |
| 2015/0255849 | A1 | 9/2015 | Sumiyosi et al. | |
| 2016/0294062 | A1 | 10/2016 | Lo Hine Tong et al. | |
| 2017/0012345 | A1 | 1/2017 | Zhang et al. | |
| 2017/0084990 | A1 | 3/2017 | Le Thuc et al. | |
| 2017/0244149 | A1 | 8/2017 | Kim et al. | |
| 2021/0359418 | A1 | 11/2021 | Yoshikawa | |
| 2021/0399435 | A1 | 12/2021 | Yoshikawa | |

* cited by examiner

ANTENNA, WIRELESS COMMUNICATION MODULE, AND WIRELESS COMMUNICATION DEVICE

CROSS-REFERENCE TO RELATED APPLICATIONS

This application is a National Stage of PCT international application Ser. No. PCT/JP2019/042058 filed on Oct. 25, 2019 which designates the United States, incorporated herein by reference, and which is based upon and claims the benefit of priority from Japanese Patent Application No. 2018-206002 filed on Oct. 31, 2018, the entire contents of which are incorporated herein by reference.

FIELD

The present disclosure relates to an antenna, a wireless communication module, and a wireless communication device.

BACKGROUND

In an array antenna, an antenna for multiple-input multiple-output (MIMO), and the like; a plurality of antenna elements are arranged close to each other. When the plurality of antenna elements are arranged close to each other, mutual coupling between the antenna elements can be increased. When the mutual coupling between the antenna elements is increased, radiation efficiency of the antenna elements may decrease.

Therefore, a technique for reducing the mutual coupling between the antenna elements has been proposed (for example, Patent Literature 1).

CITATION LIST

Patent Literature

Patent Literature 1: JP 2017-504274 A

SUMMARY

An antenna according to an embodiment of the present disclosure includes a first antenna element, a second antenna element, a first coupler, and a second coupler. The first antenna element includes a first radiation conductor and a first feeder line and is configured to resonate in a first frequency band. The second antenna element includes a second radiation conductor and a second feeder line and is configured to resonate in a second frequency band. The second feeder line is configured to be coupled to the first feeder line such that a first component is dominant. The first component is one of a capacitance component and an inductance component. The first coupler is configured to couple the first feeder line and the second feeder line such that a second component different from the first component is dominant. The first radiation conductor and the second radiation conductor are arranged at an interval equal to or less than ½ of a resonance wavelength. The second radiation conductor is configured to be coupled to the first radiation conductor with a first coupling method in which one of a capacitive coupling and a magnetic field coupling is dominant. The second coupler is configured to couple the first radiation conductor and the second radiation conductor with a second coupling method different from the first coupling method.

A wireless communication module according to an embodiment of the present disclosure includes the above-described antenna and an RF module. The RF module is configured to be electrically connected to at least one of the first feeder line and the second feeder line.

A wireless communication device according to an embodiment of the present disclosure includes the above-described wireless communication module and a battery. The battery is configured to supply power to the wireless communication module.

DESCRIPTION OF EMBODIMENTS

Figure 1:
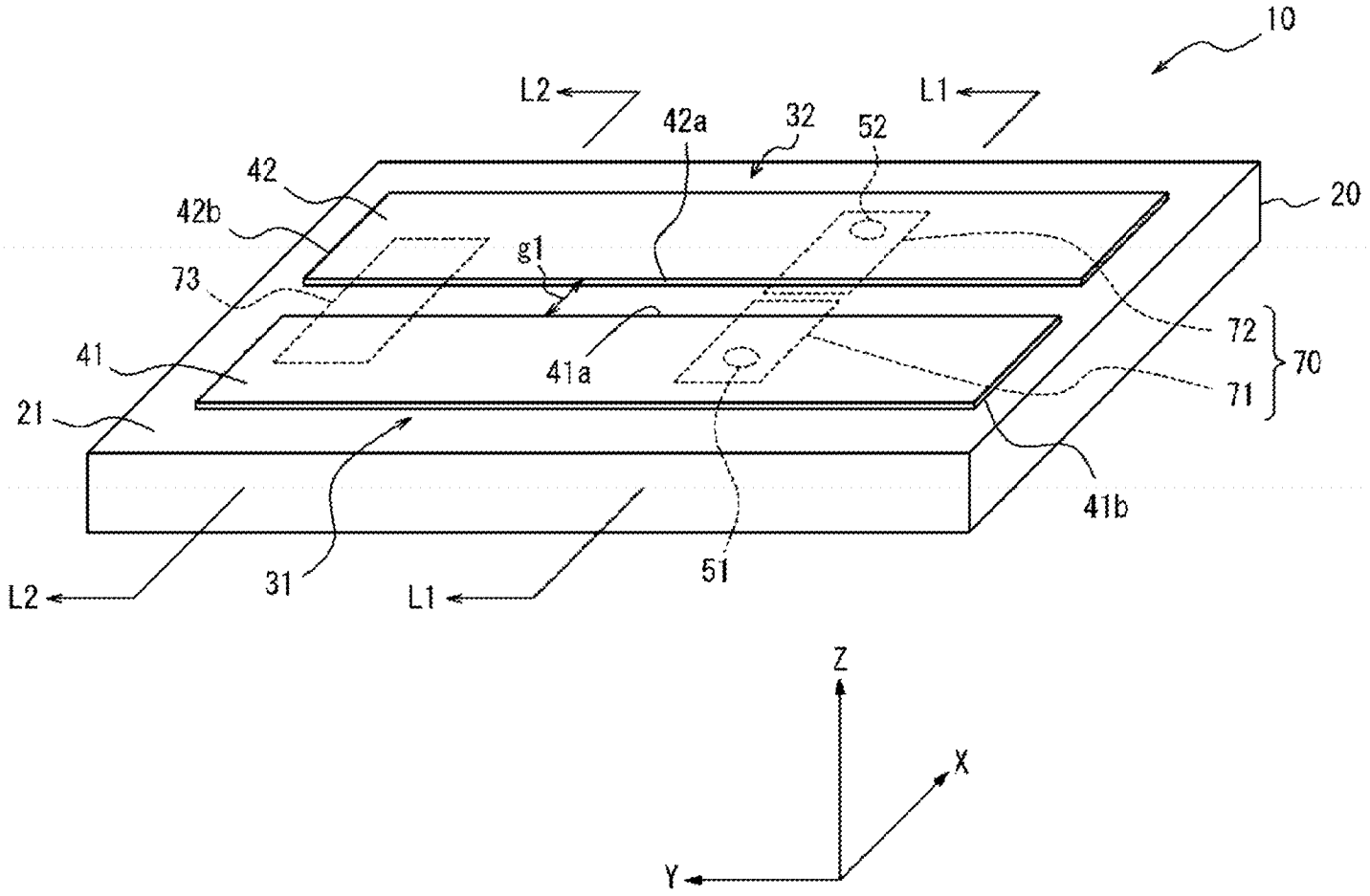
FIG. 1 is a perspective view of an antenna according to an embodiment.

There is room for improvement in the conventional technique for reducing mutual coupling between the antenna elements.

The present disclosure relates to providing an antenna, a wireless communication module, and a wireless communication device with reduced mutual coupling between antenna elements.

According to the antenna, the wireless communication module, and the wireless communication device according to an embodiment of the present disclosure, the mutual coupling between the antenna elements can be reduced.

In the present disclosure, a "dielectric material" may include either a ceramic material or a resin material as a composition. The ceramic material includes an aluminum oxide sintered body, an aluminum nitride sintered body, a mullite sintered body, a glass ceramic sintered body, a crystallized glass obtained by precipitating a crystal component in a glass base material, and microcrystalline sintered body such as mica or aluminum titanate. The resin material includes a material obtained by curing an uncured material such as an epoxy resin, a polyester resin, a polyimide resin, a polyamide-imide resin, a polyetherimide resin, and a liquid crystal polymer.

In the present disclosure, a "conductive material" can include, as a composition, any of a metallic material, a metallic alloy, a cured material of metallic paste, and a conductive polymer. The metallic material includes copper, silver, palladium, gold, platinum, aluminum, chromium, nickel, cadmium lead, selenium, manganese, tin, vanadium, lithium, cobalt, titanium, and the like. The alloy includes a plurality of metallic materials. The metallic paste includes a paste formed by kneading the powder of a metallic material along with an organic solvent and a binder. The binder includes an epoxy resin, a polyester resin, a polyimide resin, a polyamide-imide resin, and a polyetherimide resin. The conductive polymer includes a polythiophene-based polymer, a polyacetylene-based polymer, a polyaniline-based polymer, a polypyrrole-based polymer, and the like.

Hereinafter, a plurality of embodiments of the present disclosure will be described with reference to the drawings. In the components illustrated in FIGS. 1 to 22, the same components are designated by the same reference numerals.

In the embodiments of the present disclosure, a plane on which a first antenna element 31 and a second antenna element 32 illustrated in FIG. 1 extend is represented as an XY plane. A direction from a first ground conductor 61 illustrated in FIG. 2 toward a first radiation conductor 41 illustrated in FIG. 1 is represented as a positive direction of a Z axis. The opposite direction is represented as a negative direction of the Z axis. In the embodiments of the present disclosure, when a positive direction of an X axis and a negative direction of the X axis are not particularly distinguished, the positive direction of the X axis and the negative direction of the X axis are collectively referred to as "X direction". When a positive direction of a Y axis and a negative direction of the Y axis are not particularly distinguished, the positive direction of the Y axis and the negative direction of the Y axis are collectively referred to as "Y direction". When the positive direction of the Z axis and the negative direction of the Z axis are not particularly distinguished, the positive direction of the Z axis and the negative direction of the Z axis are collectively referred to as "Z direction".

Figure 2:
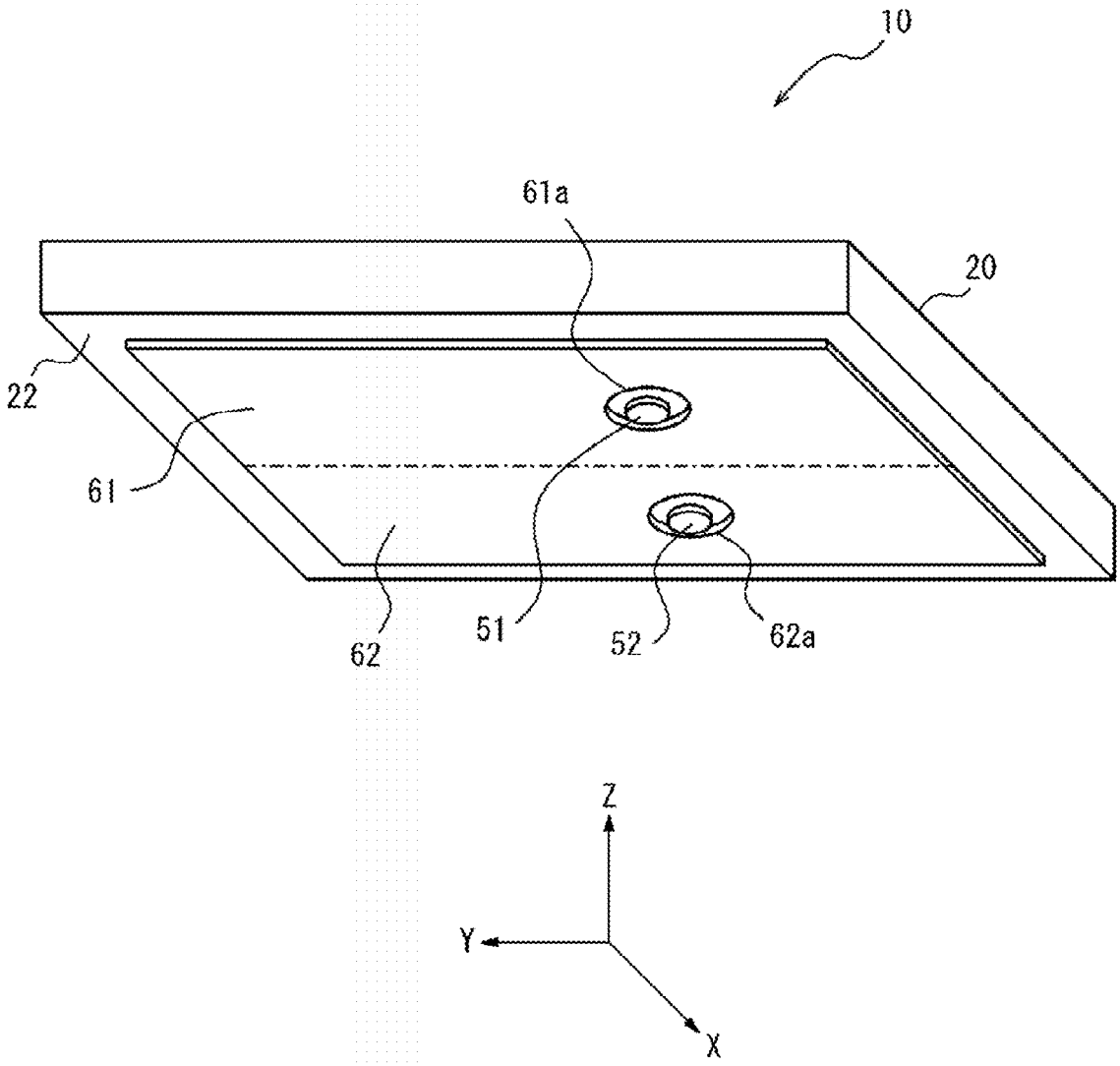
FIG. 2 is a perspective view of the antenna illustrated in FIG. 1 as viewed from a negative direction side of a Z axis.
Figure 3:
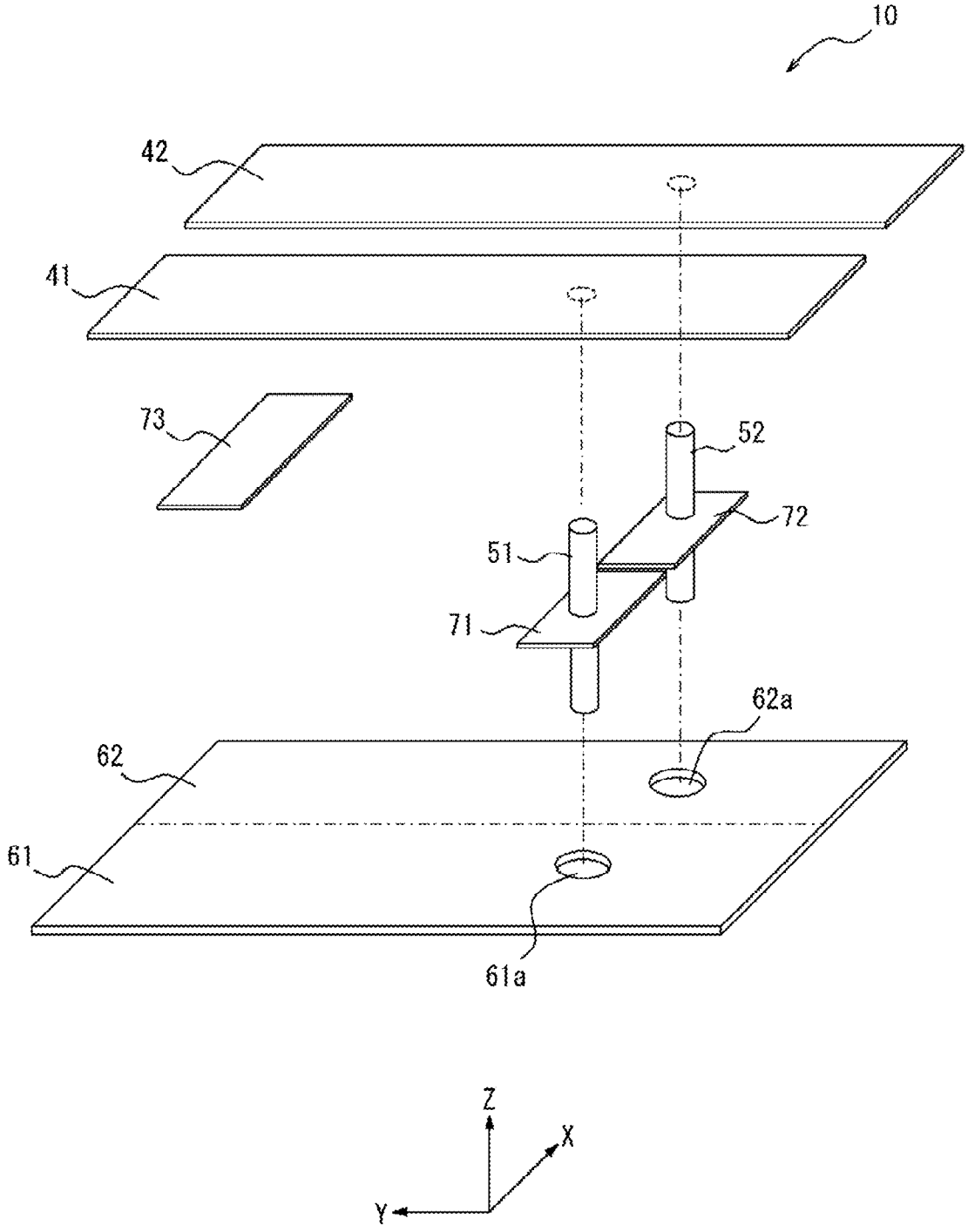
FIG. 3 is an exploded perspective view of a portion of the antenna illustrated in FIG. 1.
Figure 4:
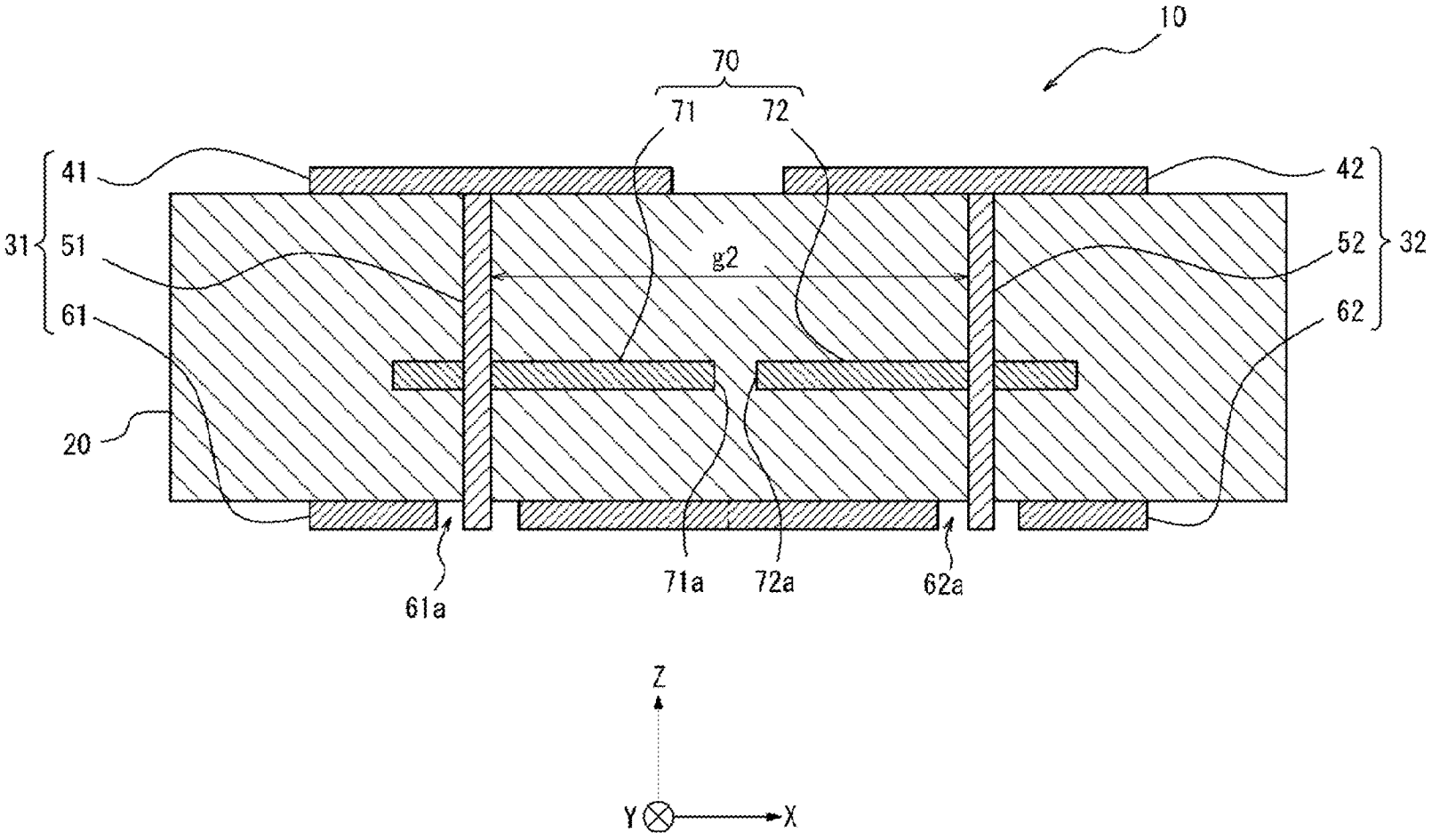
FIG. 4 is a cross-sectional view of the antenna taken along line L1-L1 illustrated in FIG. 1.
Figure 5:
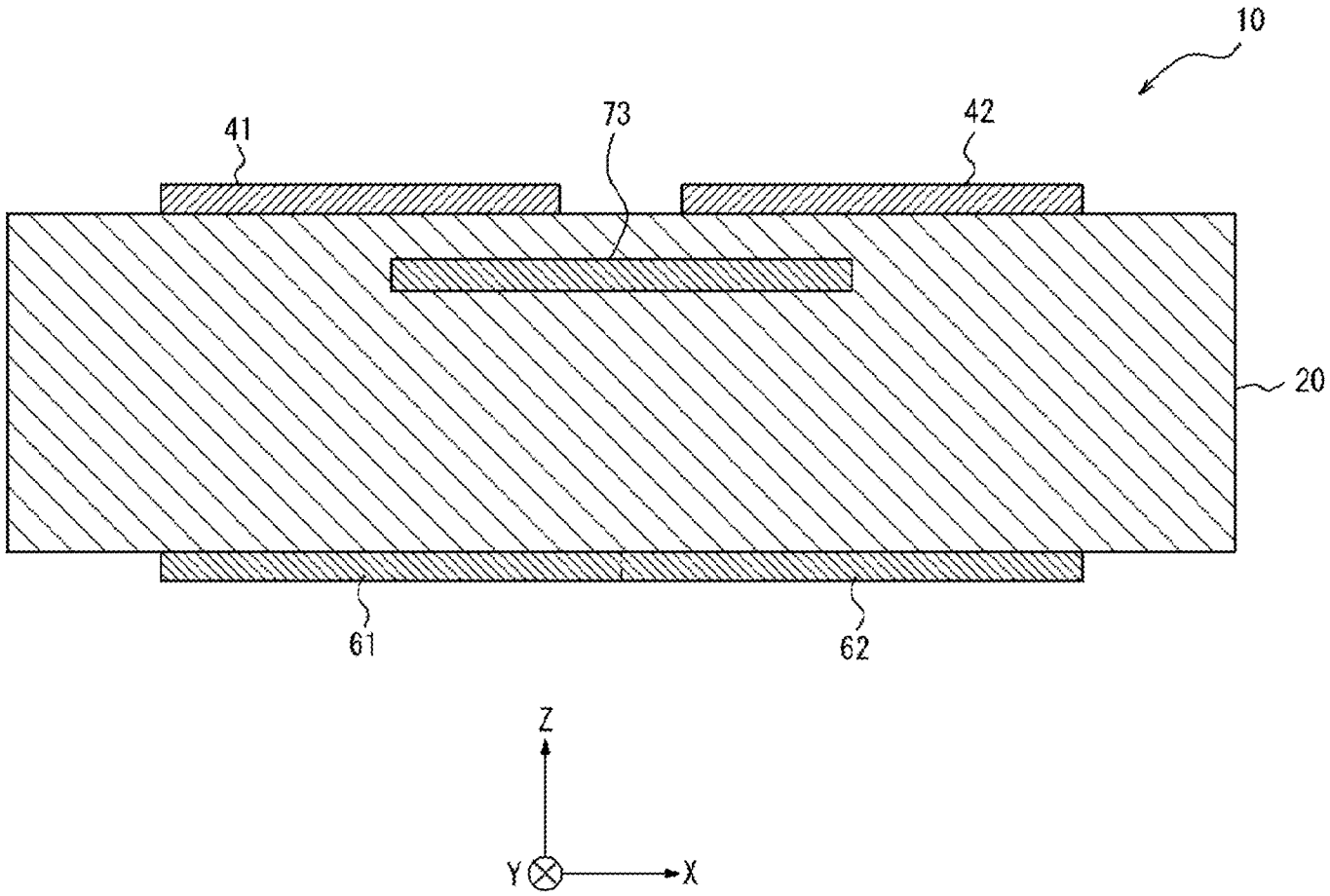
FIG. 5 is a cross-sectional view of the antenna taken along line L2-L2 illustrated in FIG. 1.

FIG. 1 is a perspective view of an antenna 10 according to an embodiment. FIG. 2 is a perspective view of the antenna 10 illustrated in FIG. 1 as viewed from the negative direction side of the Z axis. FIG. 3 is an exploded perspective view of a portion of the antenna 10 illustrated in FIG. 1. FIG. 4 is a cross-sectional view of the antenna 10 taken along line L1-L1 illustrated in FIG. 1. FIG. 5 is a cross-sectional view of the antenna 10 taken along line L2-L2 illustrated in FIG. 1.

As illustrated in FIG. 1, the antenna 10 has a base 20, a first antenna element 31, a second antenna element 32, a first coupler 70, and a second coupler 73.

The base 20 is configured to support the first antenna element 31 and the second antenna element 32. The base 20 is a quadrangular prism as illustrated in FIGS. 1 and 2. However, the base 20 may have any shape as long as it can support the first antenna element 31 and the second antenna element 32.

The base 20 may include a dielectric material. A relative permittivity of the base 20 may be appropriately adjusted according to a desired resonance frequency of the antenna 10. The base 20 includes an upper surface 21 and a lower surface 22 as illustrated in FIGS. 1 and 2.

The first antenna element 31 is configured to resonate in a first frequency band. The second antenna element 32 is configured to resonate in a second frequency band. The first frequency band and the second frequency band may belong to the same frequency band or different frequency bands, depending on the use of the antenna 10 and the like. The first antenna element 31 can resonate in the same frequency band as the second antenna element 32. The first antenna element 31 can resonate in a frequency band different from that of the second antenna element 32.

The first antenna element 31 may be configured to resonate in the same phase as the second antenna element 32. A first feeder line 51 and a second feeder line 52 may be configured to feed signals that excite the first antenna element 31 and the second antenna element 32 in the same phase. When the first antenna element 31 and the second antenna element 32 are excited in the same phase, the signal fed from the first feeder line 51 to the first antenna element 31 may have the same phase as the signal fed from the second feeder line 52 to the second antenna element 32. When the first antenna element 31 and the second antenna element 32 are excited in the same phase, the signal fed from the first feeder line 51 to the first antenna element 31 may have a different phase from the signal fed from the second feeder line 52 to the second antenna element 32.

The first antenna element 31 may be configured to resonate in a phase different from that of the second antenna element 32. The first feeder line 51 and the second feeder line 52 may be configured to feed signals that excite the first antenna element 31 and the second antenna element 32 in different phases. When the first antenna element 31 and the second antenna element 32 are excited in different phases, the signal fed from the first feeder line 51 to the first antenna element 31 may have the same phase as the signal fed from the second feeder line 52 to the second antenna element 32. When the first antenna element 31 and the second antenna element 32 are excited in different phases, the signal fed from the first feeder line 51 to the first antenna element 31 may have a different phase from the signal fed from the second feeder line 52 to the second antenna element 32.

As illustrated in FIG. 4, the first antenna element 31 includes a first radiation conductor 41 and the first feeder line 51. The first antenna element 31 may further include a first ground conductor 61. The first antenna element 31 serves as a microstrip type antenna by including the first ground conductor 61. As illustrated in FIG. 4, the second antenna element 32 includes a second radiation conductor 42 and the second feeder line 52. The second antenna element 32 may further include a second ground conductor 62. The second antenna element 32 serves as a microstrip type antenna by including the second ground conductor 62.

The first radiation conductor 41 illustrated in FIG. 1 is configured to radiate power supplied from the first feeder line 51 as electromagnetic waves. The first radiation conductor 41 is configured to supply electromagnetic waves from the outside as power to the first feeder line 51. The second radiation conductor 42 illustrated in FIG. 1 is configured to radiate power supplied from the second feeder line 52 as electromagnetic waves. The second radiation conductor 42 is configured to supply electromagnetic waves from the outside as power to the second feeder line 52.

Each of the first radiation conductor 41 and the second radiation conductor 42 may include a conductive material. Each of the first radiation conductor 41, the second radiation conductor 42, the first feeder line 51, the second feeder line 52, the first ground conductor 61, the second ground conductor 62, the first coupler 70, and the second coupler 73 may include the same conductive material, or may include different conductive materials.

The first radiation conductor 41 and the second radiation conductor 42 may have a flat plate shape as illustrated in FIG. 1. The first radiation conductor 41 and the second radiation conductor 42 can extend along the XY plane. The first radiation conductor 41 and the second radiation conductor 42 are located on the upper surface 21 of the base 20. The first radiation conductor 41 and the second radiation conductor 42 may be located partially in the base 20.

In the present embodiment, the first radiation conductor 41 and the second radiation conductor 42 have the same rectangular shape. However, the first radiation conductor 41 and the second radiation conductor 42 may have any shape. In addition, the first radiation conductor 41 and the second radiation conductor 42 may have different shapes.

A longitudinal direction of the first radiation conductor 41 and the second radiation conductor 42 is along the Y direction. A lateral direction of the first radiation conductor 41 and the second radiation conductor 42 is along the X direction. The first radiation conductor 41 includes a long side 41*a* and a short side 41*b*. The second radiation conductor 42 includes a long side 42*a* and a short side 42*b*.

The first radiation conductor 41 and the second radiation conductor 42 are arranged so that the long side 41*a* and the long side 42*a* face each other. However, the arrangement of the first radiation conductor 41 and the second radiation conductor 42 is not limited thereto. For example, the first radiation conductor 41 and the second radiation conductor 42 may be arranged side by side so that a portion of the long side 41*a* and a portion of the long side 42*a* face each other. For example, the first radiation conductor 41 and the second radiation conductor 42 may be arranged to be shifted in the Y direction.

The first radiation conductor 41 and the second radiation conductor 42 may be arranged side by side so that the short side 41*b* and the short side 42*b* face each other. However, the arrangement of the first radiation conductor 41 and the second radiation conductor 42 is not limited thereto. For example, the first radiation conductor 41 and the second radiation conductor 42 may be arranged side by side so that a portion of the short side 41*b* and a portion of the short side 42*b* face each other. For example, the first radiation conductor 41 and the second radiation conductor 42 may be arranged with the short side 41*b* and the short side 42*b* facing each other being shift from each other.

The first radiation conductor 41 and the second radiation conductor 42 are arranged at an interval equal to or less than ½ of the resonance wavelength of the antenna 10. In the present embodiment, as illustrated in FIG. 1, the first radiation conductor 41 and the second radiation conductor 42 are arranged so that a gap g1 between the long side 41*a* and the long side 42*a* facing each other is equal to or less than ½ of the resonance wavelength of the antenna 10. However, the arrangement of the first radiation conductor 41 and the second radiation conductor 42 at an interval equal to or less than ½ of the resonance wavelength of the antenna 10 is not limited thereto. For example, in a configuration in which the first radiation conductor 41 and the second radiation conductor 42 are arranged so that the short side 41*b* and the short side 42*b* face each other, a gap between the short side 41*b* and the short side 42*b* may be equal to or less than ½ of the resonance wavelength of the antenna 10.

A current can flow through the first radiation conductor 41 along the Y direction. When the current flows through the first radiation conductor 41 along the Y direction, a magnetic field surrounding the first radiation conductor 41 changes in the XZ plane. A current can flow through the second radiation conductor 42 along the Y direction. When the current flows through the second radiation conductor 42 along the Y direction, a magnetic field surrounding the second radiation conductor 42 changes in the XZ plane. The magnetic field surrounding the first radiation conductor 41 and the magnetic field surrounding the second radiation conductor 42 interact with each other. For example, when the first radiation conductor 41 and the second radiation conductor 42 are excited in the same phase or phases close to each other, most of the currents flowing through the first radiation conductor 41 and the second radiation conductor 42 can flow in the same direction. Examples of the phases close to each other include cases where both phases are within ±60°, within ±45°, and within ±30°. When most of the currents flowing through the first radiation conductor 41 and the second radiation conductor 42 flow in the same direction, magnetic field coupling between the first radiation conductor 41 and the second radiation conductor 42 can be large. The first radiation conductor 41 and the second radiation conductor 42 can be configured so that the magnetic field coupling becomes large by flowing most of the flowing currents in the same direction.

When the resonance frequencies of the first radiation conductor 41 and the second radiation conductor 42 are the same or close to each other, the first radiation conductor 41 and the second radiation conductor 42 may be configured so that a coupling occurs at the time of resonance. The coupling at the time of resonance can be referred to as "even mode" and "odd mode". The even mode and the odd mode are also collectively referred to as the "even-odd mode". When the first radiation conductor 41 and the second radiation conductor 42 resonate in the even-odd mode, each of the first radiation conductor 41 and the second radiation conductor 42 resonates at a resonance frequency different from the case where they do not resonate in the even-odd mode. In many cases in which the first radiation conductor 41 and the second radiation conductor 42 are coupled, magnetic field coupling and electric field coupling occur at the same time. If one of the magnetic field coupling and the electric field coupling becomes dominant, the coupling between the first radiation conductor 41 and the second radiation conductor can finally be regarded as the dominant one of the magnetic field coupling or the electric field coupling.

The second radiation conductor 42 is configured to be coupled to the first radiation conductor 41 with a first coupling method in which one of the capacitive coupling and the magnetic field coupling is dominant. In the present embodiment, the first radiation conductor 41 and the second radiation conductor 42 are the microstrip type antennas, and the long side 41*a* and the long side 42*a* face each other. The mutual influence of the magnetic field surrounding the first radiation conductor 41 and the magnetic fields surrounding the second radiation conductor 42 is more dominant than the mutual influence due to the electric field between the first radiation conductor 41 and the second radiation conductor 42. The coupling between the first radiation conductor 41 and the second radiation conductor 42 can be considered as the magnetic field coupling. Therefore, in the present embodiment, the second radiation conductor 42 is configured to be coupled to the first radiation conductor 41 with the first coupling method in which the magnetic field coupling is dominant.

The first feeder line 51 illustrated in FIG. 3 is configured to be electrically connected to the first radiation conductor 41. The first feeder line 51 is configured to be coupled to the first radiation conductor 41 such that the inductance component is dominant. However, the first feeder line 51 may be configured to be magnetically coupled to the first radiation conductor 41. When the first feeder line 51 is configured to be magnetically coupled to the first radiation conductor 41, the first feeder line 51 may be configured to be coupled to the first radiation conductor 41 such that the capacitance component is dominant. The first feeder line 51 may extend from an opening 61*a* of the first ground conductor 61 illustrated in FIG. 2 to an external device or the like.

The second feeder line 52 illustrated in FIG. 3 is configured to be electrically connected to the second radiation conductor 42. The second feeder line 52 is configured to be coupled to the second radiation conductor 42 such that the inductance component is dominant. However, the second feeder line 52 may be configured to be magnetically coupled to the second radiation conductor 42. When the second feeder line 52 is configured to be magnetically coupled to the second radiation conductor 42, the second feeder line 52 may be configured to be coupled to the second radiation conductor 42 such that the capacitance component is dominant. The second feeder line 52 can extend from an opening 62*a* of the second ground conductor 62 illustrated in FIG. 2 to an external device or the like.

The first feeder line 51 is configured to supply power to the first radiation conductor 41. The first feeder line 51 is configured to supply the power from the first radiation conductor 41 to an external device or the like. The second feeder line 52 is configured to supply power to the second radiation conductor 42. The second feeder line 52 is configured to supply the power from the second radiation conductor 42 to an external device or the like.

The first feeder line 51 and the second feeder line 52 may include a conductive material. Each of the first feeder line 51 and the second feeder line 52 may be a through-hole conductor, a via conductor, or the like. The first feeder line 51 and the second feeder line 52 may be located in the base 20 as illustrated in FIG. 4. The first feeder line 51 penetrates through a first conductor 71 of the first coupler 70. The second feeder line 52 penetrates through a second conductor 72 of the first coupler 70.

As illustrated in FIG. 4, the first feeder line 51 extends in the Z direction in the base 20. The first feeder line 51 is configured so that a current flows along the Z direction. When the current flows through the first feeder line 51 along the Z direction, the magnetic field surrounding the first feeder line 51 changes in the XY plane.

As illustrated in FIG. 4, the second feeder line 52 extends in the Z direction in the base 20. The second feeder line 52 is configured so that a current flows along the Z direction. When the current flows through the second feeder line 52 along the Z direction, the magnetic field surrounding the second feeder line 52 changes in the XY plane.

The magnetic field surrounding the first feeder line 51 and the magnetic field surrounding the second feeder line 52 can interfere with each other. For example, when most of the currents flowing through the first feeder line 51 and the second feeder line 52 flow in the same direction, the magnetic field surrounding the first feeder line 51 and the magnetic field surrounding the second feeder line 52 constructively interfere with each other in a macroscopic manner. The first feeder line 51 and the second feeder line 52 can be magnetically coupled by interference between the magnetic field surrounding the first feeder line 51 and the magnetic field surrounding the second feeder line 52.

The second feeder line 52 is configured to be coupled to the first feeder line 51 such that a first component is dominant. The first component is one of the capacitance component and the inductance component. The first feeder line 51 and the second feeder line 52 can be magnetically coupled by interference between the magnetic field surrounding the first feeder line 51 and the magnetic field surrounding the second feeder line 52. The second feeder line 52 is configured to be coupled to the first feeder line 51 such that the inductance component serving as the first component is dominant.

The first ground conductor 61 illustrated in FIG. 2 is configured to provide a reference potential in the first antenna element 31. The second ground conductor 62 illustrated in FIG. 2 is configured to provide a reference potential in the second antenna element 32. Each of the first ground conductor 61 and the second ground conductor 62 may be configured to be electrically connected to a ground of the device including the antenna 10.

The first ground conductor 61 and the second ground conductor 62 may include a conductive material. The first ground conductor 61 and the second ground conductor 62 may have a flat plate shape. The first ground conductor 61 and the second ground conductor 62 are located on the lower surface 22 of the base 20. The first ground conductor 61 and the second ground conductor 62 may be located partially in the base 20.

The first ground conductor 61 may be connected to the second ground conductor 62. For example, the first ground conductor 61 may be configured to be electrically connected to the second ground conductor 62. The first ground conductor 61 and the second ground conductor 62 may be formed integrally as illustrated in FIG. 2. The first ground conductor 61 and the second ground conductor 62 may be integrated with a single base 20. However, the first ground conductor 61 and the second ground conductor 62 may be independent and separate members. When the first ground conductor 61 and the second ground conductor 62 are independent and separate members, each of the first ground conductor 61 and the second ground conductor 62 can be integrated with the base 20 separately.

The first ground conductor 61 and the second ground conductor 62 extend along the XY plane, as illustrated in FIG. 2. Each of the first ground conductor 61 and the second ground conductor 62 is separated from each of the first radiation conductor 41 and the second radiation conductor 42 in the Z direction. As illustrated in FIG. 4, the base 20 is interposed between the first ground conductor 61 and the second ground conductor 62 and the first radiation conductor 41 and the second radiation conductor 42. The first ground conductor 61 faces the first radiation conductor 41 in the Z direction. The second ground conductor 62 faces the second radiation conductor 42 in the Z direction. The first ground conductor 61 and the second ground conductor 62 have a rectangular shape according to the first radiation conductor 41 and the second radiation conductor 42. However, the first ground conductor 61 and the second ground conductor 62 may have any shape according to the first radiation conductor 41 and the second radiation conductor 42.

The first coupler 70 is configured to couple the first feeder line 51 and the second feeder line 52 such that a second component different from the first component is dominant. When the first component is an inductance component, the second component is a capacitance component. The first coupler 70 is configured to couple the first feeder line 51 and the second feeder line 52 such that the capacitance component serving as the second component is dominant.

For example, the first coupler 70 includes the first conductor 71 and the second conductor 72, as illustrated in FIG. 4. Each of the first conductor 71 and the second conductor 72 may include a conductive material. Each of the first conductor 71 and the second conductor 72 extends along the XY plane. Each of the first conductor 71 and the second conductor 72 has a flat plate shape as illustrated in FIG. 3. The first conductor 71 is configured to be electrically connected to the first feeder line 51 penetrating through the first conductor 71. The second conductor 72 is configured to be electrically connected to the second feeder line 52 penetrating through the second conductor 72. As illustrated in FIG. 4, an end portion 71*a* of the first conductor 71 and an end portion 72*a* of the second conductor 72 face each other. The end portion 71*a* of the first conductor 71 and the end portion 72*a* of the second conductor 72 can configure a capacitor via the base 20. By configuring the capacitor, the first coupler 70 is configured to couple the first feeder line 51 and the second feeder line 52 such that the capacitance component is dominant.

When the first feeder line 51 directly feeds power to the first radiation conductor 41 and the second feeder line 52 directly feeds power to the second radiation conductor 42, in the coupling between the first feeder line 51 and the second feeder line 52, the inductance component may be dominant. The inductance component in the coupling between the first feeder line 51 and the second feeder line 52 forms a parallel circuit with the capacitance component due to the first coupler 70. In the antenna 10, an anti-resonance circuit including the inductance component and the capacitance component is configured. The anti-resonance circuit can cause an attenuation pole in transmission characteristics between the first antenna element 31 and the second antenna element 32. The transmission characteristics are characteristics of power transmitted from the first feeder line 51, which is an input port of the first antenna element 31, to the second feeder line 52, which is an input port of the second antenna element 32. By causing the attenuation pole in the transmission characteristics, the interference between the first antenna element 31 and the second antenna element 32 can be reduced in the antenna 10.

In this way, the first coupler 70 is configured to couple the first feeder line 51, which is the input port of the first antenna element 31, and the second feeder line 52, which is the input port of the second antenna element 32, such that the second component is dominant. The second component is different from the first component, which is dominant in the coupling between the first feeder line 51 itself and the second feeder line 52 itself. The first component and the second component forms a parallel circuit, so that the antenna 10 has an anti-resonance circuit at the input port.

The second coupler 73 is configured to couple the first radiation conductor 41 and the second radiation conductor 42 with a second coupling method different from the first coupling method. When the first coupling method is a coupling method in which magnetic field coupling is dominant, the second coupling method is a coupling method in which capacitive coupling is dominant. The second coupler 73 is configured to couple the first radiation conductor 41 and the second radiation conductor 42 with the second coupling method in which the capacitive coupling is dominant.

Figure 6:
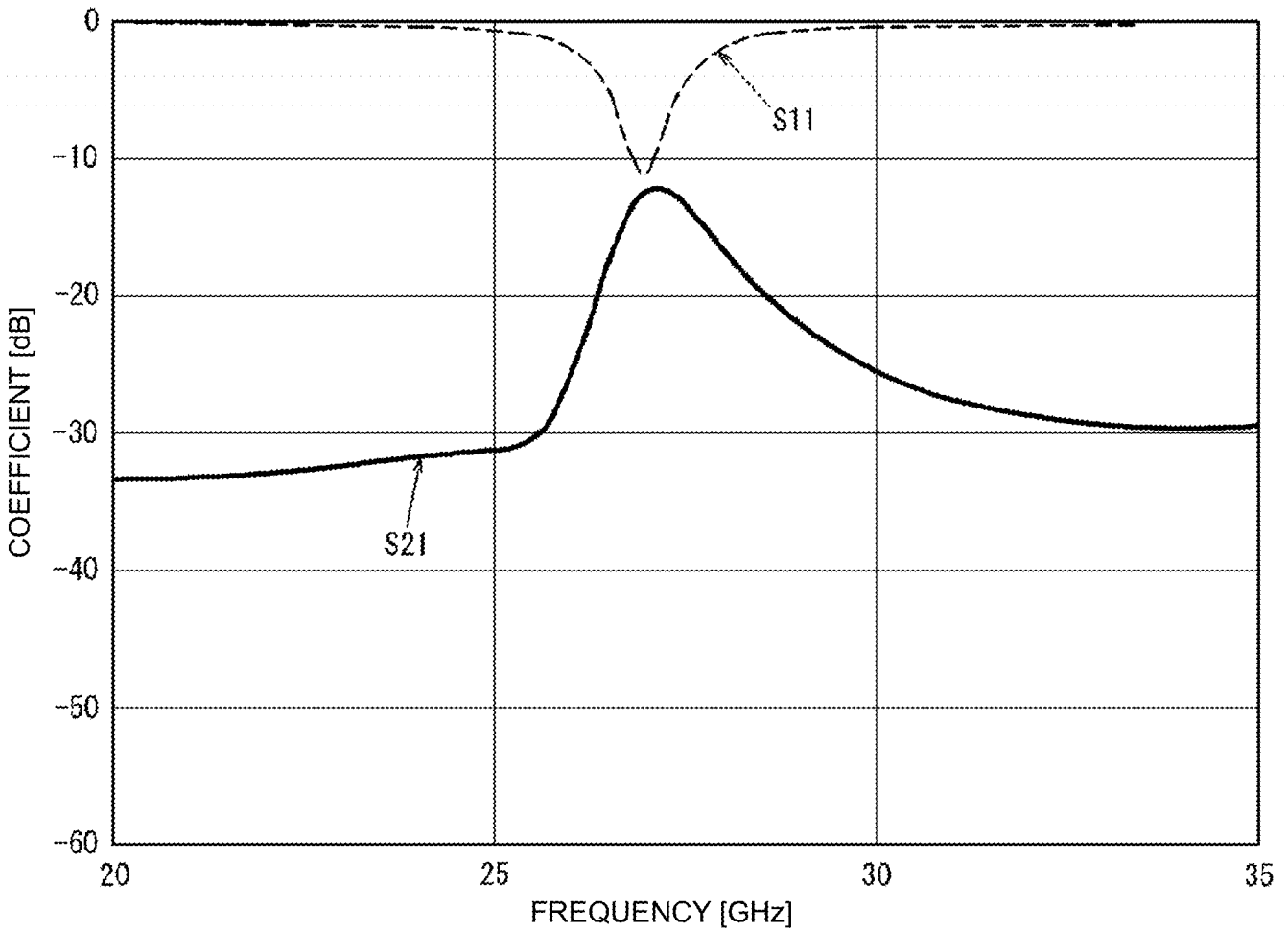
FIG. 6 is a diagram illustrating an example of simulation results of the antenna illustrated in FIG. 1.

For example, the second coupler 73 may include a conductive material. The second coupler 73 is located in the base 20 as illustrated in FIG. 6. The second coupler 73 is separated from the first radiation conductor 41 and the second radiation conductor 42 in the Z direction. The second coupler 73 extends along the XY plane, as illustrated in FIG. 1. In the XY plane, a portion of the second coupler 73 may overlap a portion of the first radiation conductor 41. The portion of the second coupler 73 and the portion of the first radiation conductor 41 that overlap can configure a capacitor via the base 20. In the XY plane, a portion of the second coupler 73 may overlap a portion of the second radiation conductor 42. The portion of the second coupler 73 and the portion of the second radiation conductor 42 that overlap can configure a capacitor via the base 20. The first radiation conductor 41 and the second radiation conductor 42 can be coupled through the capacitor configured by the first radiation conductor 41 and the second coupler 73 and the capacitor configured by the second radiation conductor 42 and the second coupler 73. The second coupler 73 is configured to couple the first radiation conductor 41 and the second radiation conductor 42 with the second coupling method in which the capacitive coupling is dominant.

The electric field is large at both ends of the first radiation conductor 41 and both ends of the second radiation conductor 42. When most of the currents flowing through the first radiation conductor 41 and the second radiation conductor 42 flow in an inverse direction, a potential difference between the first radiation conductor 41 and the second radiation conductor 42 becomes large. The magnitude of the capacitive coupling with the second coupling method changes depending on the position where the second coupler 73 faces each of the first radiation conductor 41 and the second radiation conductor 42. The magnitude of the capacitive coupling with the second coupling method can be adjusted by the position and the area where the second coupler 73 faces each of the first radiation conductor 41 and the second radiation conductor 42.

The second feeder line 52 is configured to be coupled to the first feeder line 51 such that the inductance component serving as the first component is dominant. The first coupler 70 is configured to couple the first feeder line 51 and the second feeder line 52 such that the capacitance component serving as the second component is dominant. A coupling coefficient $K_1$ due to the capacitance component and the inductance component between the first feeder line 51 and the second feeder line 52 can be calculated by using a coupling coefficient $Ke_1$ and a coupling coefficient $Km_1$. The coupling coefficient $Ke_1$ is a coupling coefficient due to the capacitance component between the first feeder line 51 and the second feeder line 52. The coupling coefficient $Km_1$ is a coupling coefficient due to an inductance component between the first feeder line 51 and the second feeder line 52. For example, the relationship between the coupling coefficient $K_1$ and the coupling coefficients $Ke_1$ and $Km_1$ is expressed by Equation:

$$K_1=(Ke_1^2-Km_1^2)/(Ke_1^2+Km_1^2).$$

The coupling coefficient $Km_1$ can be determined according to the configuration of the first feeder line 51 and the second feeder line 52. For example, the coupling coefficient $Km_1$ can change in response to a change in a length of a gap g2 between the first feeder line 51 and the second feeder line 52 illustrated in FIG. 4 in the X direction. In the antenna 10, the magnitude of the coupling coefficient $Ke_1$ can be adjusted by appropriately configuring the first coupler 70. In the antenna 10, by adjusting the magnitude of the coupling coefficient $Ke_1$ according to the coupling coefficient $Km_1$, the degree to which the coupling coefficient $Km_1$ and the coupling coefficient $Ke_1$ cancel each other can be changed. In the antenna 10, with the coupling coefficient $Ke_1$ having a magnitude corresponding to the coupling coefficient $Km_1$, the coupling coefficient $Km_1$ and the coupling coefficient $Ke_1$ cancel each other, and the coupling coefficient $K_1$ can be reduced. By reducing the coupling coefficient $K_1$, in the antenna 10, the mutual coupling between the first feeder line 51 and the second feeder line 52 can be reduced. By reducing the mutual coupling between the first feeder line 51 and the second feeder line 52, each of the first antenna element 31 and the second antenna element 32 can efficiently radiate electromagnetic waves by the power from each of the first feeder line 51 and the second feeder line 52.

The second radiation conductor 42 is configured to be coupled to the first radiation conductor 41 with the first coupling method in which the magnetic field coupling is dominant. The second coupler 73 is configured to couple the first radiation conductor 41 and the second radiation conductor 42 with the second coupling method in which the capacitive coupling is dominant. A coupling coefficient $K_2$ due to the capacitive coupling and the magnetic field coupling between the first radiation conductor 41 and the second radiation conductor 42 can be calculated by using a coupling coefficient $Ke_2$ and a coupling coefficient $Km_2$. The coupling coefficient $Ke_2$ is a coupling coefficient of the capacitive coupling between the first radiation conductor 41 and the second radiation conductor 42. The coupling coefficient $Km_2$ is a coupling coefficient of the magnetic field coupling between the first radiation conductor 41 and the second radiation conductor 42. For example, the relationship between the coupling coefficient $K_2$ and the coupling coefficients $Ke_2$ and $Km_2$ is expressed by Equation:

$$K_2=(Ke_2^2-Km_2^2)/(Ke_2^2+Km_2^2).$$

The coupling coefficient $Km_2$ can be determined according to the configuration of the first radiation conductor 41 and the second radiation conductor 42. For example, a configuration in which the first radiation conductor 41 and the second radiation conductor 42 are arranged in the Y direction as illustrated in FIG. 1 and a configuration in which the first radiation conductor 41 and the second radiation conductor 42 are arranged to be shifted in the Y direction can be different from each other in the coupling coefficient $Km_2$. The coupling coefficient $Km_2$ can change in response to a change in a length of the gap g1 illustrated in FIG. 1 in the X direction. In the antenna 10, the magnitude of the coupling coefficient $Ke_2$ can be adjusted by appropriately configuring the second coupler 73. In the antenna 10, by adjusting the magnitude of the coupling coefficient $Ke_2$ according to the coupling coefficient $Km_2$, the degree to which the coupling coefficient $Km_2$ and the coupling coefficient $Ke_2$ cancel each other can be changed. In the antenna 10, the coupling coefficient $Km_2$ and the coupling coefficient $Ke_2$ cancel each other, and the coupling coefficient $K_2$ can be reduced. By reducing the coupling coefficient $K_2$, in the antenna 10, the mutual coupling between the first radiation conductor 41 and the second radiation conductor 42 can be reduced. By reducing the mutual coupling between the first radiation conductor 41 and the second radiation conductor 42, each of the first antenna element 31 and the second antenna element 32 can efficiently radiate electromagnetic waves from each of the first radiation conductor 41 and the second radiation conductor 42.

<Simulation Result>

FIG. 6 is a diagram illustrating an example of simulation results of the antenna 10 illustrated in FIG. 1. A broken line indicates a reflection coefficient S11. A solid line indicates a transmission coefficient S21. In the simulation illustrated in FIG. 6, a range from a frequency of 25 GHz (gigahertz) to a frequency of 30 GHz was set as a target frequency band.

The reflection coefficient S11 indicates a ratio of the power that is reflected by the first radiation conductor 41 and returns to the first feeder line 51 among the power supplied from the first feeder line 51 to the first radiation conductor 41. In the present embodiment, the reflection coefficient S11 can have one local minimum value by reducing the mutual coupling between the first radiation conductor 41 and the second radiation conductor 42, which will be described in detail later. The reflection coefficient S11 takes a local minimum value of about −11 dB (decibel) in the vicinity of a frequency of 28 GHz.

The transmission coefficient S21 indicates a ratio of the power transmitted to the second feeder line 52 among the power supplied to the first feeder line 51. In the present embodiment, a peak value of the transmission coefficient S21 can be reduced by reducing the mutual coupling between the first feeder line 51 and the second feeder line 52, which will be described in detail later. The transmission coefficient S21 has a peak value of about −12 dB in the vicinity of the frequency of 28 GHz.

Figure 7:
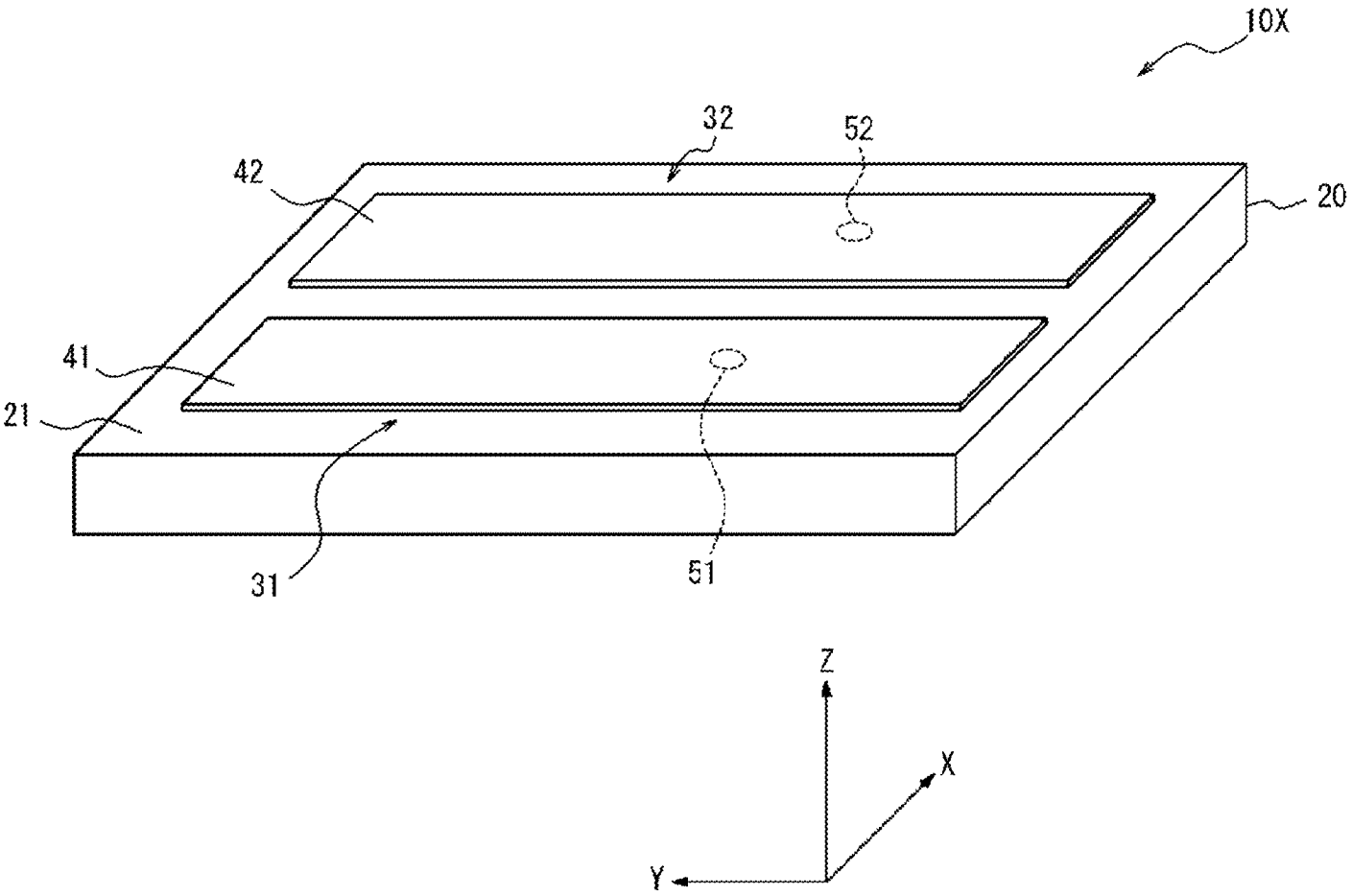
FIG. 7 is a perspective view of an antenna according to a comparative example.

FIG. 7 is a perspective view of an antenna 10X according to a comparative example. Unlike the antenna 10 illustrated in FIG. 1, the antenna 10X does not have the first coupler 70 and the second coupler 73.

It is assumed that: a coupling coefficient due to a capacitance component and an inductance component between the first feeder line 51 and the second feeder line 52 in the comparative example is a coupling coefficient $Kx_1$; a coupling coefficient due to the capacitance component between the first feeder line 51 and the second feeder line 52 is $Kex_1$; and a coupling coefficient due to the inductance component between the first feeder line 51 and the second feeder line 52 is a coupling coefficient $Kmx_1$. In the same as or similar to the present embodiment, even in the comparative example, the coupling coefficient $Kx_1$ can be calculated by using the coupling coefficient $Kex_1$ and the coupling coefficient $Kmx_1$. For example, the relationship between the coupling coefficient $Kx_1$ and the coupling coefficients $Kex_1$ and $Kmx_1$ is expressed by Equation:

$$Kx_1=(Kex_1^2-Kmx_1^2)/(Kex_1^2+Kmx_1^2).$$

The antenna 10X of the comparative example does not have the first coupler 70. In the antenna 10X of the comparative example, the degree to which the coupling coefficient $Kmx_1$ and the coupling coefficient $Kex_1$ cancel each other cannot be adjusted. In the antenna 10X of the comparative example, the coupling coefficient $Kx_1$ cannot be adjusted because the degree to which the coupling coefficient $Kmx_1$ and the coupling coefficient $Kex_1$ cancel each other cannot be adjusted. In the antenna 10X of the comparative example, the mutual coupling between the first feeder line 51 and the second feeder line 52 can be larger than that of the antenna 10. In contrast, since the antenna 10 has the first coupler 70, the coupling coefficient $K_1$ can be adjusted to make it smaller.

It is assumed that: a coupling coefficient due to the capacitive coupling and the magnetic field coupling between the first radiation conductor 41 and the second radiation conductor 42 in the comparative example is a coupling coefficient $Kx_2$; a coupling coefficient of the capacitive coupling between the first radiation conductor 41 and the second radiation conductor 42 is a coupling coefficient $Kex_2$; and a coupling coefficient of the magnetic field coupling between the first radiation conductor 41 and the second radiation conductor 42 is a coupling coefficient $Kmx_2$. Same as or similar to the present embodiment, even in the comparative example, the coupling coefficient $Kx_2$ can be calculated by using the coupling coefficient $Kex_2$ and the coupling coefficient $Kmx_2$. For example, the relationship between the coupling coefficient $Kx_2$ and the coupling coefficients $Kex_2$ and $Kmx_2$ is expressed by Equation:

$$Kx_2=(Kex_2^2-Kmx_2^2)/(Kex_2^2+Kmx_2^2).$$

The antenna 10X of the comparative example does not have the second coupler 73. In the antenna 10X of the comparative example, the degree to which the coupling coefficient $Kmx_2$ and the coupling coefficient $Kex_2$ cancel each other cannot be adjusted. The antenna 10X of the comparative example cannot adjust the coupling coefficient $Kx_2$ because the degree to which the coupling coefficient $Kmx_2$ and the coupling coefficient $Kex_2$ cancel each other cannot be adjusted. In the antenna 10X of the comparative example, the mutual coupling between the first radiation conductor 41 and the second radiation conductor 42 can be larger than that of the antenna 10. In contrast, since the antenna 10 has the second coupler 73, the coupling coefficient $K_2$ can be adjusted to make it smaller.

In general, coupling occurs when resonators with the same resonance frequency approach each other. In the antenna 10X of the comparative example, the even-odd mode occurs because the mutual coupling between the first radiation conductor 41 and the second radiation conductor 42 is large. The antenna 10X of the comparative example resonates at different resonance frequencies in the even mode and the odd mode. In the antenna 10X of the comparative example, the radiation efficiency of electromagnetic waves can be lowered by resonating in the even-odd modes of different resonance frequencies.

<Simulation Result>

Figure 8:
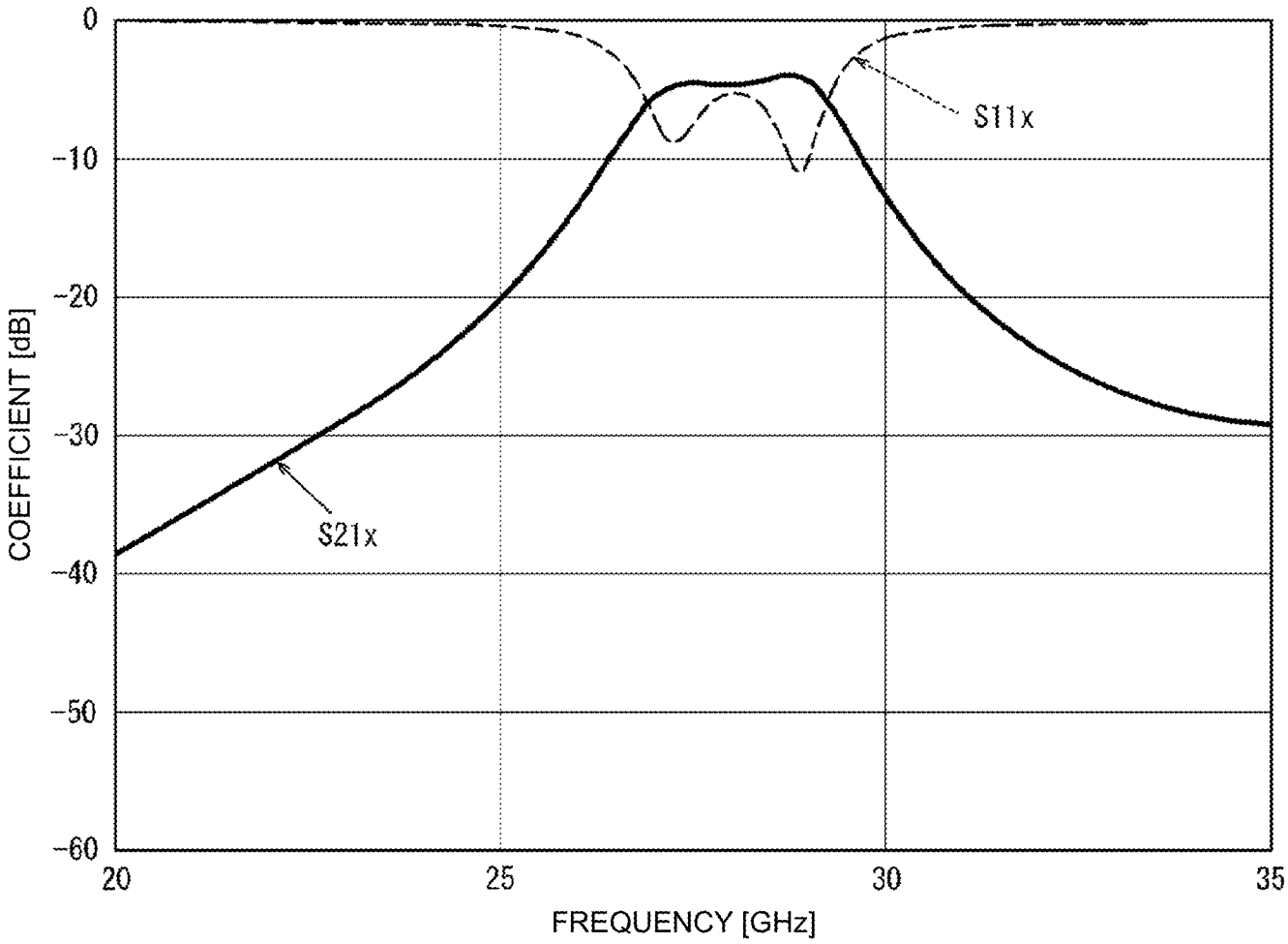
FIG. 8 is a diagram illustrating an example of simulation results of the antenna according to the comparative example.

FIG. 8 is a diagram illustrating an example of simulation results of the antenna 10X according to the comparative example. In the simulation illustrated in FIG. 8, a range from a frequency of 25 GHz to a frequency of 30 GHz was set as a target frequency band, as in the simulation illustrated in FIG. 6.

A broken line indicates a reflection coefficient S11*x* of the antenna 10X according to the comparative example. A solid line indicates a transmission coefficient S21*x* of the antenna 10X according to the comparative example.

The reflection coefficient S11*x* takes a local minimum value of about −9 dB in the vicinity of the frequency of 27 GHz. The reflection coefficient S11*x* takes a local minimum value of about −10 dB in the vicinity of the frequency of 29 GHz. In the comparative example, the reflection coefficient S11*x* takes two local minimum values.

The fact that the reflection coefficient S11*x* takes the two minimum values indicates that the antenna 10X has two resonance frequencies. The two resonance frequencies of the antenna 10X are caused by the even and odd modes. The resonance of the antenna 10X in the even-odd mode indicates that the mutual coupling between the first antenna element 31 and the second antenna element 32 is large. Since each of the first antenna element 31 and the second antenna element 32 resonates in the even-odd mode, the radiation efficiency of electromagnetic waves by each of the first radiation conductor 41 and the second radiation conductor 42 becomes low.

The transmission coefficient S21*x* has a peak value of about −5 dB in a frequency range from 27 GHz to 29 GHz. The peak value of the transmission coefficient S21*x* is larger than that of the transmission coefficient S21 of the present embodiment illustrated in FIG. 6. A large transmission coefficient S21*x* indicates a large ratio of power transmitted from the first feeder line 51 to the second feeder line 52.

In contrast to such a comparative example, the antenna 10 has the first coupler 70, as illustrated in FIG. 1. In the present embodiment, the antenna 10 having the first coupler 70 can reduce the mutual coupling between the first feeder line 51 and the second feeder line 52. Since the mutual coupling between the first feeder line 51 and the second feeder line 52 is reduced, the power transmitted from the first feeder line 51 to the second feeder line 52 can be reduced, for example, in the present embodiment. By reducing the power transmitted from the first feeder line 51 to the second feeder line 52, a radiation efficiency of the electromagnetic waves can be increased with respect to the power supplied from each of the first feeder line 51 and the second feeder line 52.

In contrast to such a comparative example, in the present embodiment, the antenna 10 has the second coupler 73 as illustrated in FIG. 1. In the present embodiment, since the antenna 10 has the second coupler 73, the mutual coupling between the first radiation conductor 41 and the second radiation conductor 42 can be reduced. By reducing the mutual coupling between the first radiation conductor 41 and the second radiation conductor 42, the radiation efficiency of electromagnetic waves from each of the first radiation conductor 41 and the second radiation conductor 42 can be increased. In the present embodiment, by reducing the mutual coupling between the first radiation conductor 41 and the second radiation conductor 42, a change in resonance frequency caused by the resonance of the antenna 10 in the even-odd mode can be reduced.

The antenna 10 has the first coupler 70 that reduces the mutual coupling between the first feeder line 51 and the second feeder line 52, and the second coupler 73 that reduces the mutual coupling between the first radiation conductor 41 and the second radiation conductor 42. The antenna 10 separately reduces the two mutual couplings by the first coupler 70 and the second coupler 73, which are different couplers. The first coupler 70 and the second coupler 73 are independent of each other. By having the first coupler 70 and the second coupler 73, the antenna 10 can increase the flexibility in design for reducing the mutual coupling.

Figure 9:
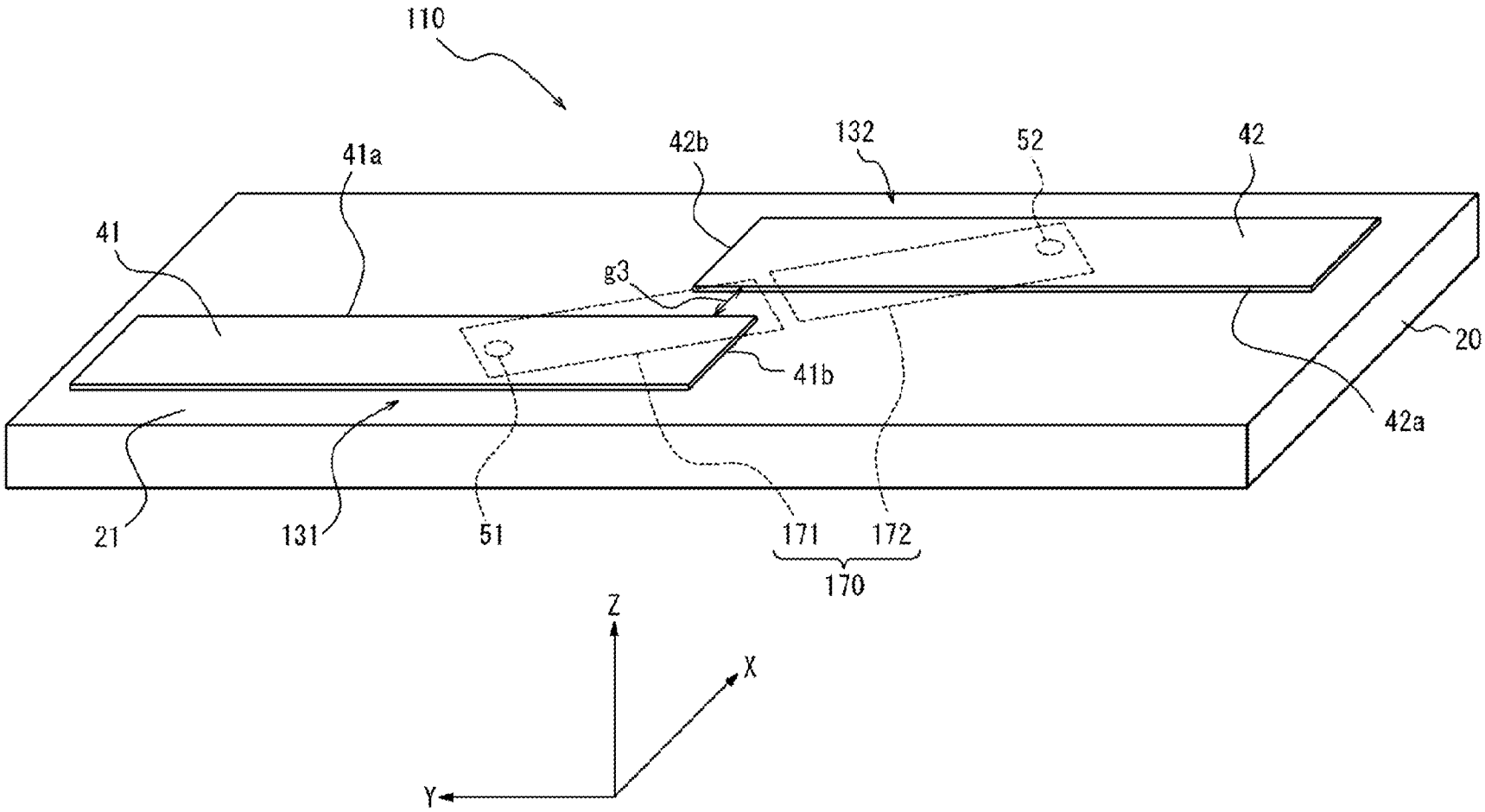
FIG. 9 is a perspective view of an antenna according to an embodiment.
Figure 10:
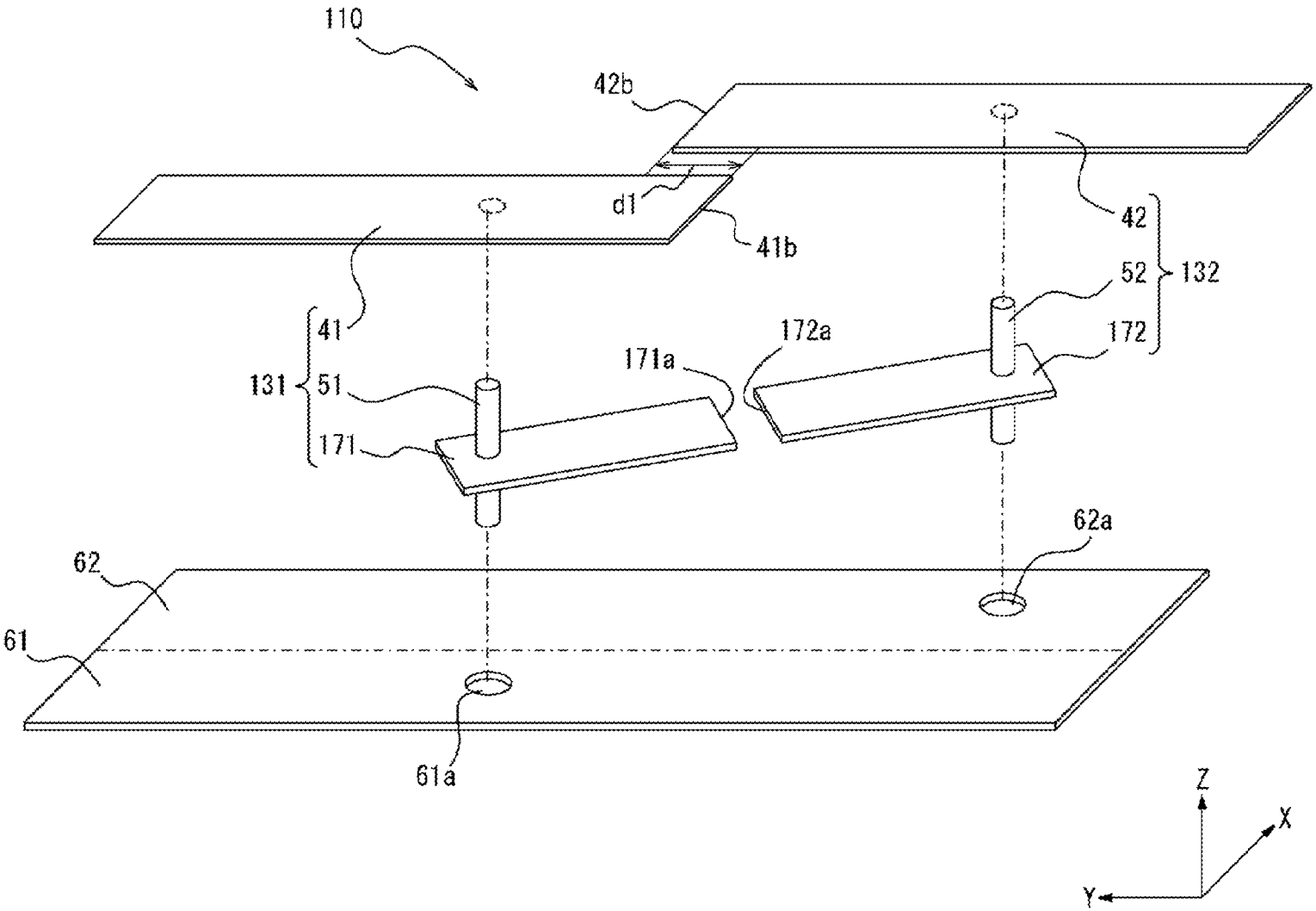
FIG. 10 is an exploded perspective view of a portion of the antenna illustrated in FIG. 9.

FIG. 9 is a perspective view of an antenna 110 according to an embodiment. FIG. 10 is an exploded perspective view of a portion of the antenna 110 illustrated in FIG. 9.

As illustrated in FIG. 9, the antenna 110 has the base 20, a first antenna element 131, a second antenna element 132, and a first coupler 170.

As illustrated in FIG. 10, the first antenna element 131 includes a first radiation conductor 41 and a first feeder line 51. The first antenna element 131 may further include the first ground conductor 61. The second antenna element 132 includes a second radiation conductor 42 and a second feeder line 52. The second antenna element 132 may further include the second ground conductor 62.

The first radiation conductor 41 and the second radiation conductor 42 are arranged to be shifted in the long side direction, that is, in the Y direction. By arranging the first radiation conductor 41 and the second radiation conductor 42 so as to be shifted in the Y direction, a portion of the long side 41*a* and a portion of the long side 42*a* face each other. A gap g3 is generated when a portion of the long side 41*a* and a portion of the long side 42*a* face each other. A coupling coefficient $Km_3$ of the magnetic field coupling between the first radiation conductor 41 and the second radiation conductor 42 depends on a length of the gap g3 in the Y direction. The length of the gap g3 in the Y direction corresponds to an interval d1 illustrated in FIG. 10. Specifically, the coupling coefficient $Km_3$ can decrease as the interval d1 decreases.

By arranging the first radiation conductor 41 and the second radiation conductor 42 so as to be shifted in the Y direction, the interval d1 between the short side 41*b* and the short side 42*b* can be brought close to each other.

A coupling coefficient $Ke_3$ of the capacitive coupling between the first radiation conductor 41 and the second radiation conductor 42 depends on the interval d1 between the short side 41*b* and the short side 41*b* illustrated in FIG. 10. Specifically, the coupling coefficient $Ke_3$ can increase as the interval d1 decreases.

A coupling coefficient $K_3$ due to the capacitive coupling and the magnetic field coupling between the first radiation conductor 41 and the second radiation conductor 42 can be reduced by canceling the coupling coefficient $Km_3$ and the coupling coefficient $Ke_3$ each other. In the antenna 110, the interval d1 illustrated in FIG. 10 can be appropriately adjusted by appropriately adjusting the amount of shift between the first radiation conductor 41 and the second radiation conductor 42 in the Y direction. The smaller the interval d1, the smaller the coupling coefficient $Km_3$ and the larger the coupling coefficient $Ke_3$. In the antenna 110, the degree to which the coupling coefficient $Km_3$ and the coupling coefficient $Ke_3$ cancel each other can be changed by appropriately adjusting the interval d1. In the antenna 110, by adjusting the interval d1 as appropriate, the coupling coefficient $Km_3$ and the coupling coefficient $Ke_3$ can cancel each other, and the coupling coefficient $K_3$ can be reduced. By reducing the coupling coefficient $K_3$, each of the first antenna element 131 and the second antenna element 132 can efficiently radiate electromagnetic waves by each of the first radiation conductor 41 and the second radiation conductor 42.

The second feeder line 52 illustrated in FIG. 10 is configured to be coupled to the first feeder line 51 dominantly in the inductance component as the first component, in the same as or similar to the configuration illustrated in FIG. 1.

The first coupler 170 illustrated in FIG. 9 is configured to couple the first feeder line 51 and the second feeder line 52 such that the capacitance component serving as the second component is dominant, in the same as or similar to the first coupler 70 illustrated in FIG. 4. For example, the first coupler 170 illustrated in FIG. 10 includes a first conductor 171 and a second conductor 172. The first conductor 171 and the second conductor 172 may be rectangles of the same type. The first conductor 171 is configured to be electrically connected to the first feeder line 51 penetrating through the first conductor 171. The second conductor 172 is configured to be electrically connected to the second feeder line 52 penetrating through the second conductor 172. As illustrated in FIG. 10, an end portion 171*a* of the first conductor 171 and an end portion 172*a* of the second conductor 172 face each other. By facing the end portion 171*a* and the end portion 172*a*, the first coupler 170 is configured to couple the first feeder line 51 and the second feeder line 52 such that the capacitance component serving as the second component is dominant, in the same as or similar to the first coupler 70 illustrated in FIG. 4.

A coupling coefficient $K_4$ due to the capacitance component and the inductance component between the first feeder line 51 and the second feeder line 52 can be reduced by canceling a coupling coefficient $Km_4$ and a coupling coefficient $Ke_4$ each other. The coupling coefficient $Km_4$ is a coupling coefficient due to the inductance component between the first feeder line 51 and the second feeder line 52. The coupling coefficient $Ke_4$ is a coupling coefficient due to the capacitance component between the first feeder line 51 and the second feeder line 52. By appropriately configuring the first coupler 170 in the same as or similar to the configuration illustrated in FIG. 1, the degree to which the coupling coefficient $Km_4$ and the coupling coefficient $Ke_4$ cancel each other can be changed. The coupling coefficient $Km_4$ and the coupling coefficient $Ke_4$ can cancel each other, and the coupling coefficient $K_4$ can be reduced. By reducing the coupling coefficient $K_4$, the mutual coupling between the first feeder line 51 and the second feeder line 52 can be reduced in the same as or similar to the configuration illustrated in FIG. 1 in the present embodiment as well.

Other configurations and effects of the antenna 110 are the same as or similar to the configurations and effects of the antenna 10 illustrated in FIG. 1.

Figure 11:
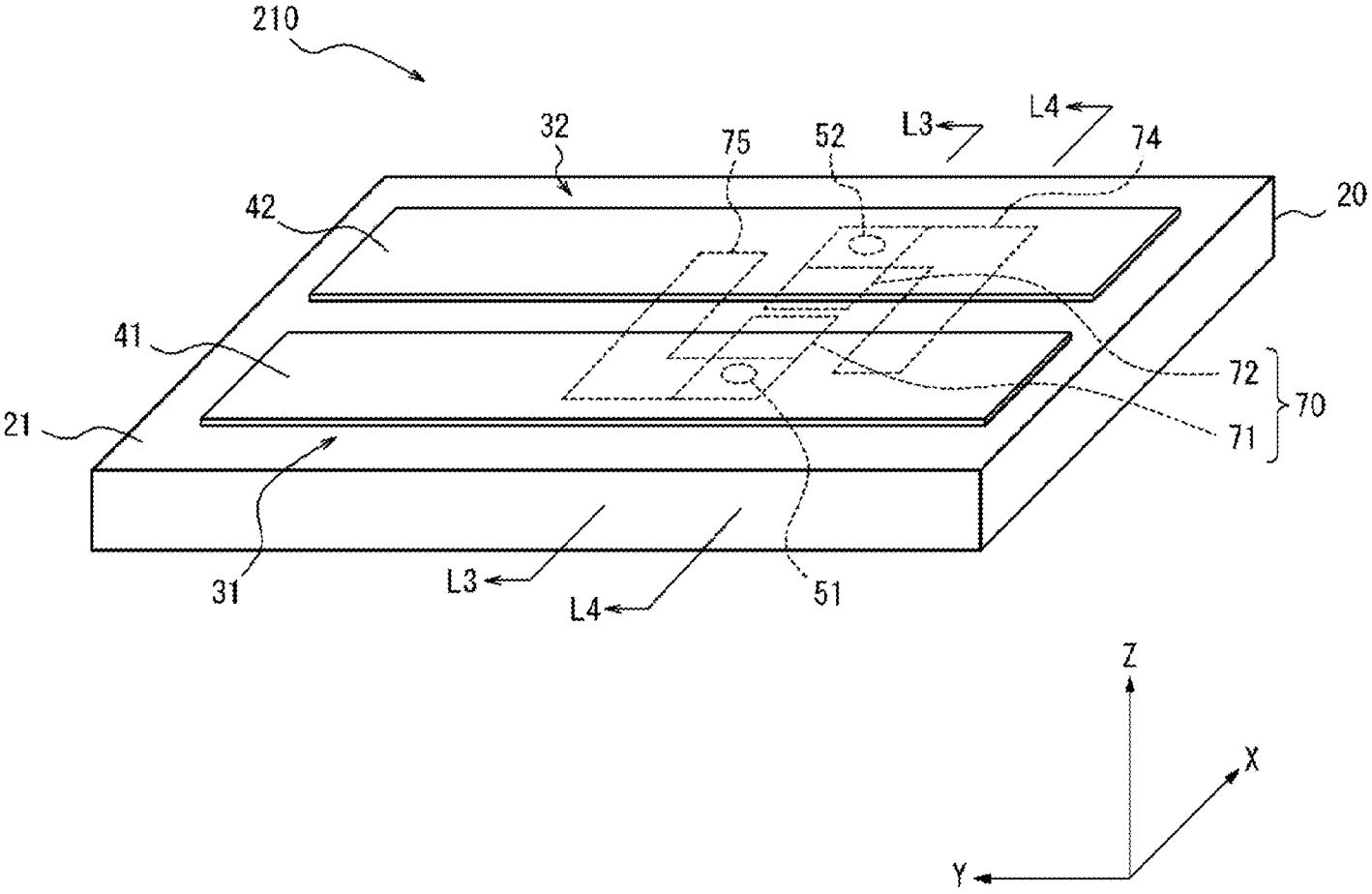
FIG. 11 is a perspective view of an antenna according to an embodiment.
Figure 12:
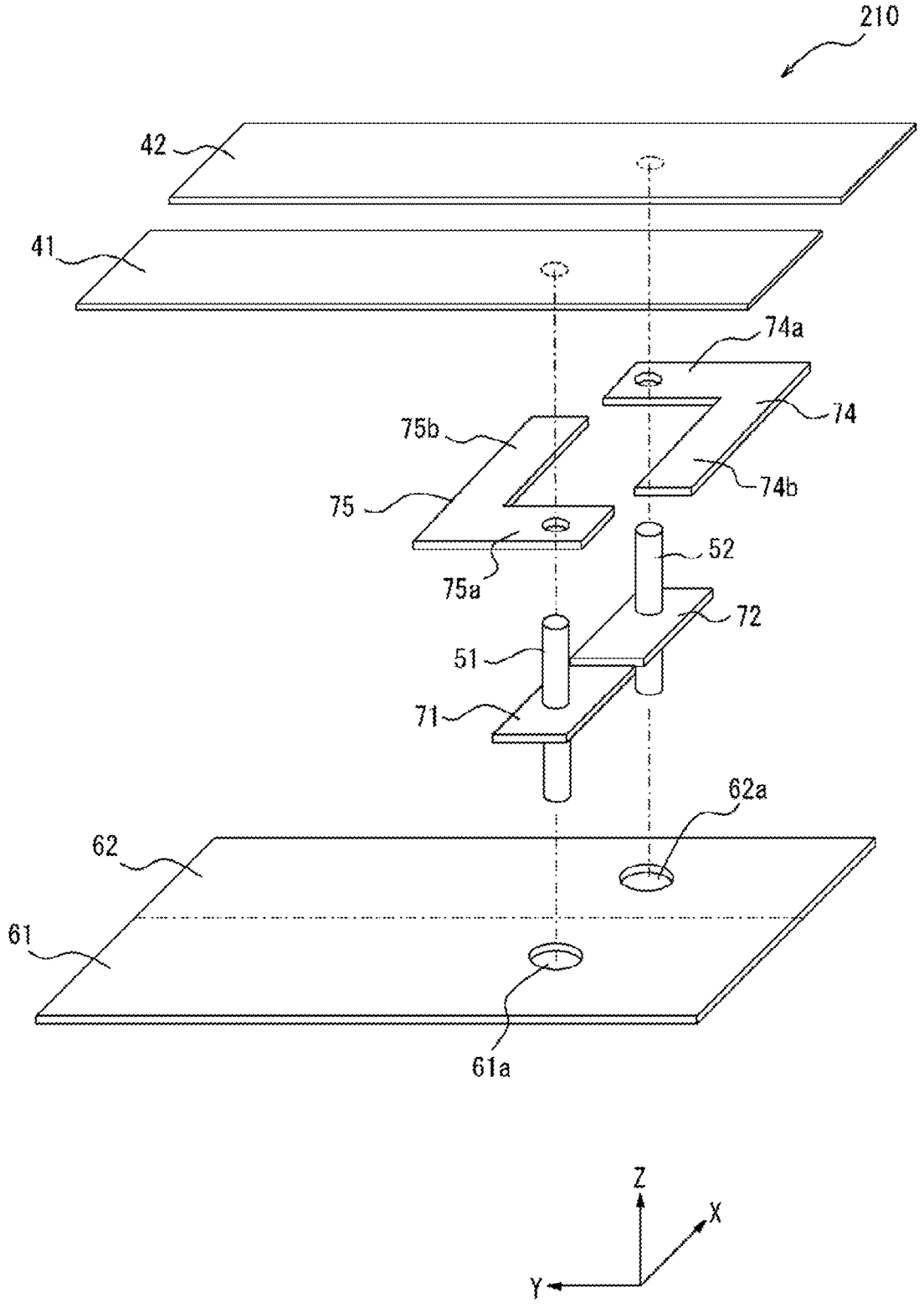
FIG. 12 is an exploded perspective view of a portion of the antenna illustrated in FIG. 11.
Figure 13:
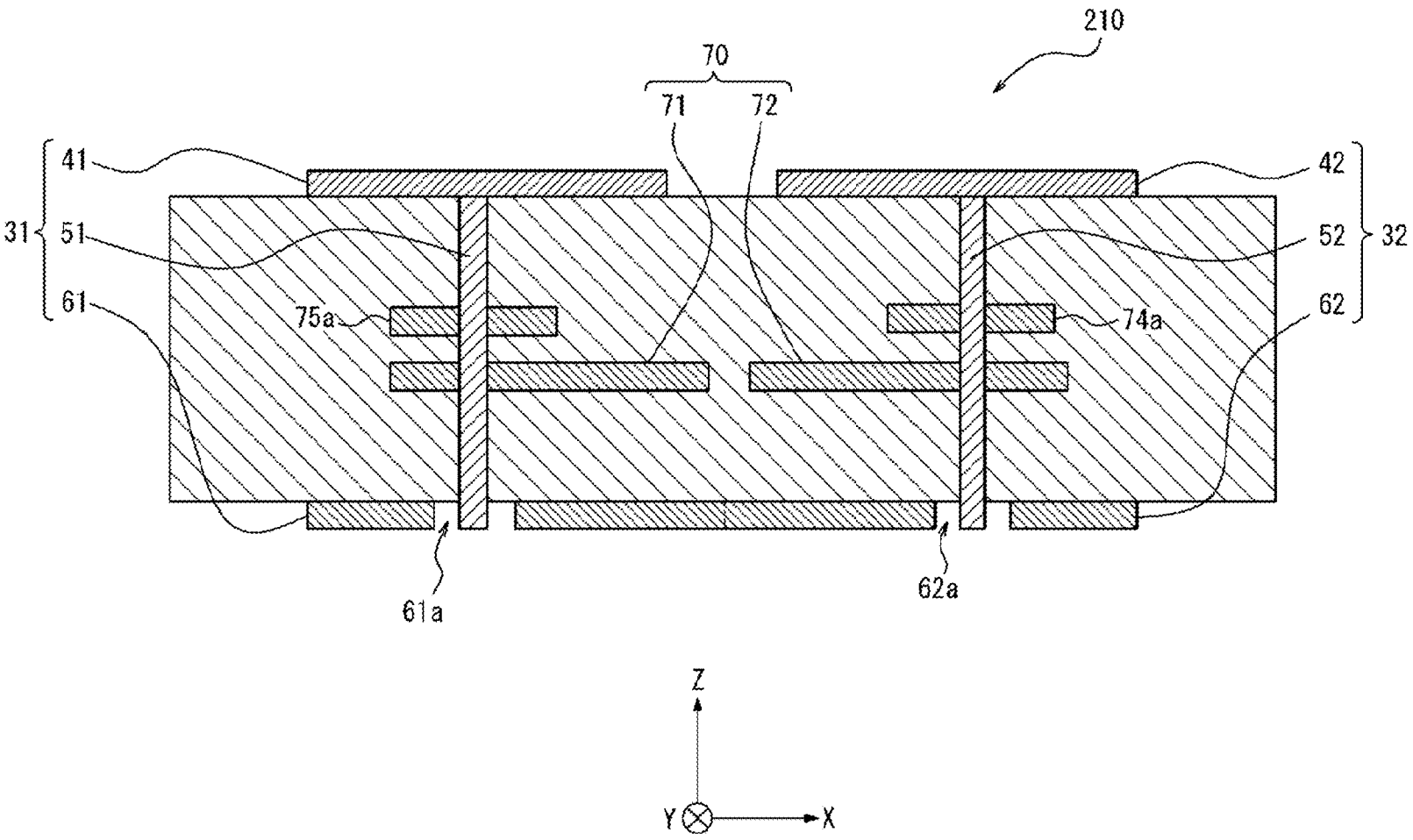
FIG. 13 is a cross-sectional view of the antenna taken along line L3-L3 illustrated in FIG. 11.
Figure 14:
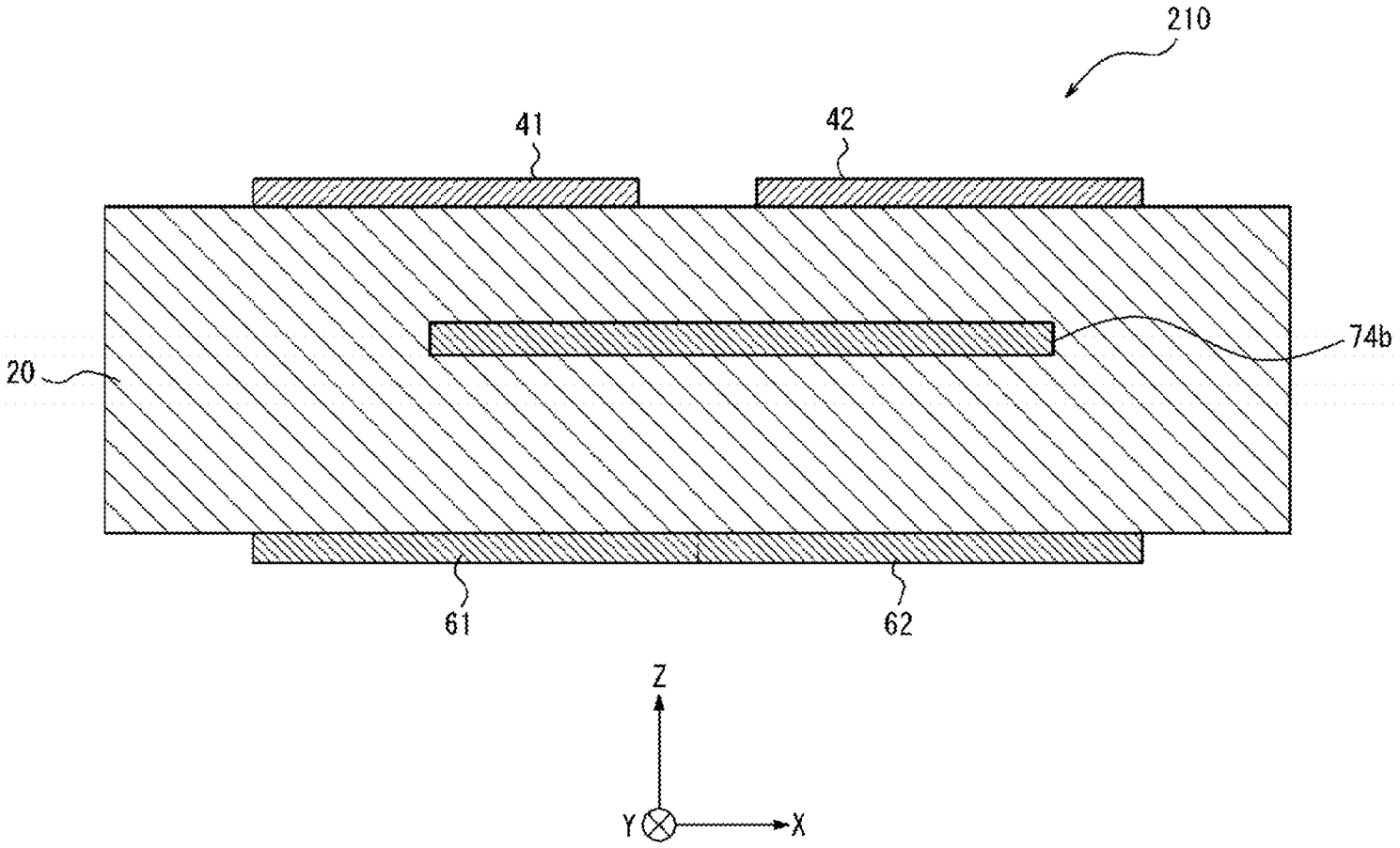
FIG. 14 is a cross-sectional view of the antenna taken along line L4-L4 illustrated in FIG. 11.

FIG. 11 is a perspective view of an antenna 210 according to an embodiment. FIG. 12 is an exploded perspective view of a portion of the antenna 210 illustrated in FIG. 11. FIG. 13 is a cross-sectional view of the antenna 210 taken along line L3-L3 illustrated in FIG. 11. FIG. 14 is a cross-sectional view of the antenna 210 taken along line L4-L4 illustrated in FIG. 11.

As illustrated in FIG. 11, the antenna 210 includes the base 20, the first antenna element 31, the second antenna element 32, the first coupler 70, and a third coupler 74. The antenna 210 may further include a fourth coupler 75.

The third coupler 74 is configured to couple the first radiation conductor 41 and the second feeder line 52.

The third coupler 74 may be configured to couple the first radiation conductor 41 and the second feeder line 52 such that one of the capacitance component and the inductance component is dominant, depending on the configuration of the first radiation conductor 41 and the second feeder line 52. In the present embodiment, the third coupler 74 is configured to couple the first radiation conductor 41 and the second feeder line 52 such that the capacitance component serving as the second component is dominant.

For example, the third coupler 74 may include a conductive material. The third coupler 74 is located in the base 20. The third coupler 74 is separated from each of the first radiation conductor 41 and the second radiation conductor 42 in the Z direction. The third coupler 74 may be L-shaped, as illustrated in FIG. 12. The L-shaped third coupler 74 includes a piece 74*a* and a piece 74*b*. As illustrated in FIG. 13, the second feeder line 52 penetrates through the piece 74*a*. The piece 74*a* is configured to be electrically connected to the second feeder line 52 by penetrating through the second feeder line 52. As illustrated in FIG. 12, the piece 74*b* overlaps a portion of the first radiation conductor 41 in the XY plane by extending from an end portion of the piece 74*a* on a negative direction side of a Y axis toward a negative direction of an X axis. The third coupler 74 is configured to be capacitively coupled to the first radiation conductor 41 by overlapping the piece 74*b* with a portion of the first radiation conductor 41 in the XY plane. The third coupler 74 is configured to couple the first radiation conductor 41 and the second feeder line 52 such that the capacitance component serving as the second component is dominant, by electrically connecting the piece 74*a* with the second feeder line 52 and capacitively connecting the piece 74*b* with the first radiation conductor 41.

A coupling coefficient $K_5$ due to the capacitance component and the inductance component between the first radiation conductor 41 and the second feeder line 52 can be reduced by canceling a coupling coefficient $Ke_5$ and a coupling coefficient $Km_5$ each other. The coupling coefficient $Ke_5$ is a coupling coefficient due to the capacitance component between the first radiation conductor 41 and the second feeder line 52. The coupling coefficient $Km_5$ is a coupling coefficient due to the inductance component between the first radiation conductor 41 and the second feeder line 52. Depending on the frequency used in the antenna 210 and the configuration of the antenna 210, the coupling coefficient $Km_5$ may be larger than the coupling coefficient $Ke_5$. In such a configuration, the degree to which the coupling coefficient $Ke_5$ and the coupling coefficient $Km_5$ cancel each other can be changed by appropriately configuring the third coupler 74. By appropriately configuring the third coupler 74, the coupling coefficient $Ke_5$ and the coupling coefficient $Km_5$ can cancel each other, and the coupling coefficient $K_5$ can be reduced. By reducing the coupling coefficient $K_5$, the mutual coupling between the first radiation conductor 41 and the second feeder line 52 can become smaller.

The fourth coupler 75 is configured to couple the second radiation conductor 42 and the first feeder line 51. The fourth coupler 75 may be configured to couple the second radiation conductor 42 and the first feeder line 51 such that one of the capacitance component and the inductance component is dominant, depending on the configuration of the second radiation conductor 42 and the first feeder line 51. In the present embodiment, the fourth coupler 75 is configured to couple the second radiation conductor 42 and the first feeder line 51 such that the capacitance component serving as the second component is dominant.

For example, the fourth coupler 75 may include a conductive material. The fourth coupler 75 is located in the base 20. The fourth coupler 75 is separated from each of the first radiation conductor 41 and the second radiation conductor 42 in the Z direction. The fourth coupler 75 may be L-shaped, as illustrated in FIG. 12. The L-shaped fourth coupler 75 includes a piece 75*a* and a piece 75*b*. In the fourth coupler 75, the piece 75*a* is electrically connected to the first feeder line 51, and the piece 75*b* is capacitively coupled to the second radiation conductor 42. With such a configuration, the fourth coupler 75 is configured to couple the second radiation conductor 42 and the first feeder line 51 such that the capacitance component serving as the second component is dominant, in the same as or similar to the third coupler 74.

A coupling coefficient $K_6$ due to the capacitance component and the inductance component between the second radiation conductor 42 and the first feeder line 51 can be reduced by canceling a coupling coefficient $Ke_6$ and a coupling coefficient $Km_6$ each other. The coupling coefficient $Ke_6$ is a coupling coefficient due to the capacitance component between the second radiation conductor 42 and the first feeder line 51. The coupling coefficient $Km_6$ is a coupling coefficient due to the inductance component between the second radiation conductor 42 and the first feeder line 51. Depending on the frequency used in the antenna 210 and the configuration of the antenna 210, the coupling coefficient $Km_6$ may be larger than the coupling coefficient $Ke_6$. In such a configuration, the degree to which the coupling coefficient $Ke_6$ and the coupling coefficient $Km_6$ cancel each other can be changed by appropriately configuring the third coupler 74. By appropriately configuring the fourth coupler 75, the coupling coefficient $Ke_6$ and the coupling coefficient $Km_6$ can cancel each other, and the coupling coefficient $K_6$ can be reduced. By reducing the coupling coefficient $K_6$, the mutual coupling between the second radiation conductor 42 and the first feeder line 51 can become smaller.

Other configurations and effects of the antenna 210 are the same as or similar to the configurations and effects of the antenna 10 illustrated in FIG. 1.

Figure 15:
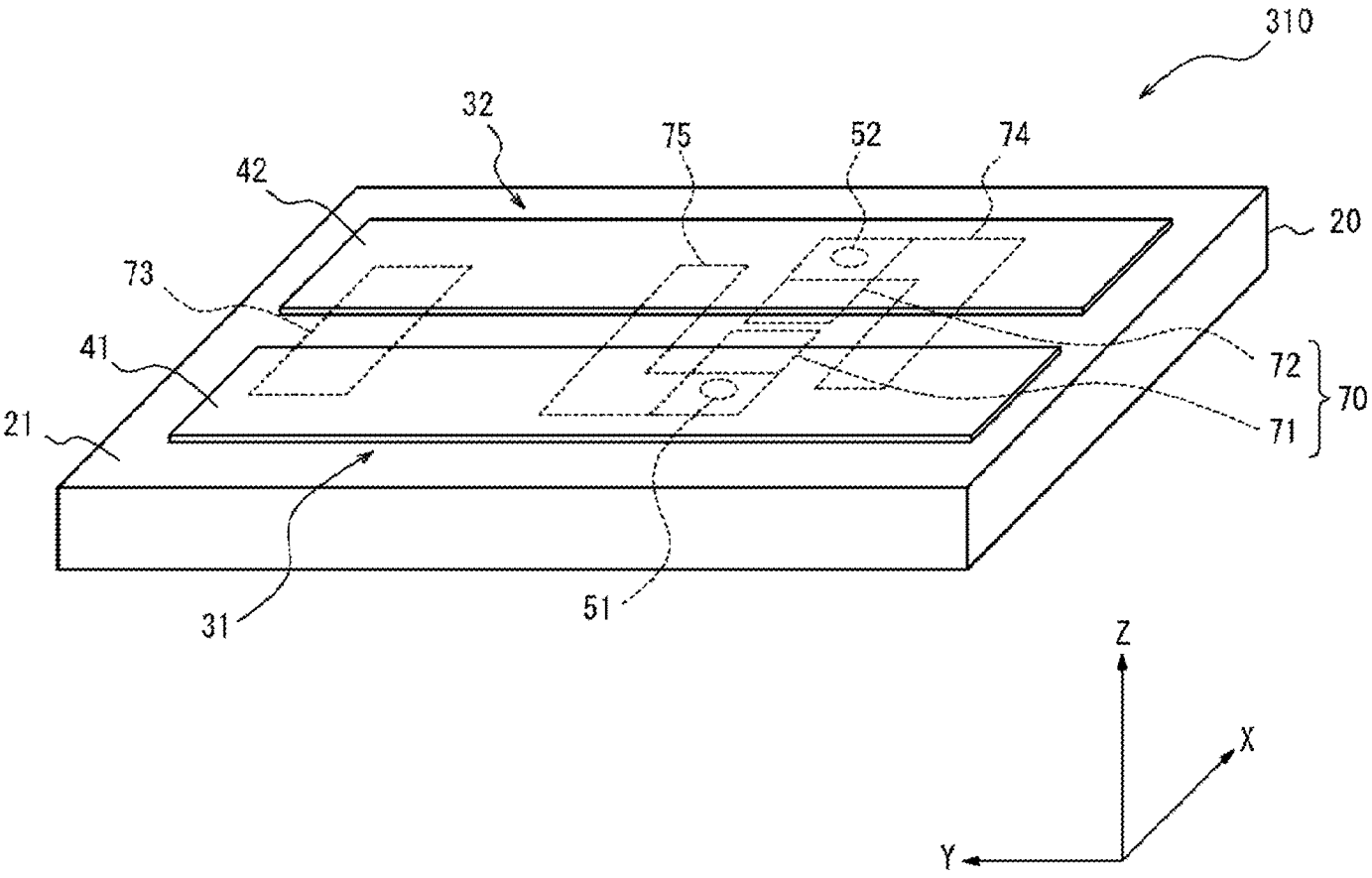
FIG. 15 is a perspective view of an antenna according to an embodiment.

FIG. 15 is a perspective view of an antenna 310 according to an embodiment. The antenna 310 has the base 20, the first antenna element 31, the second antenna element 32, the first coupler 70, the second coupler 73, the third coupler 74, and the fourth coupler 75.

The configurations and effects of the antenna 310 are the same as or similar to the configurations and effects of the antenna 10 illustrated in FIG. 1 and the configurations and effects of the antenna 210 illustrated in FIG. 11.

Figure 16:
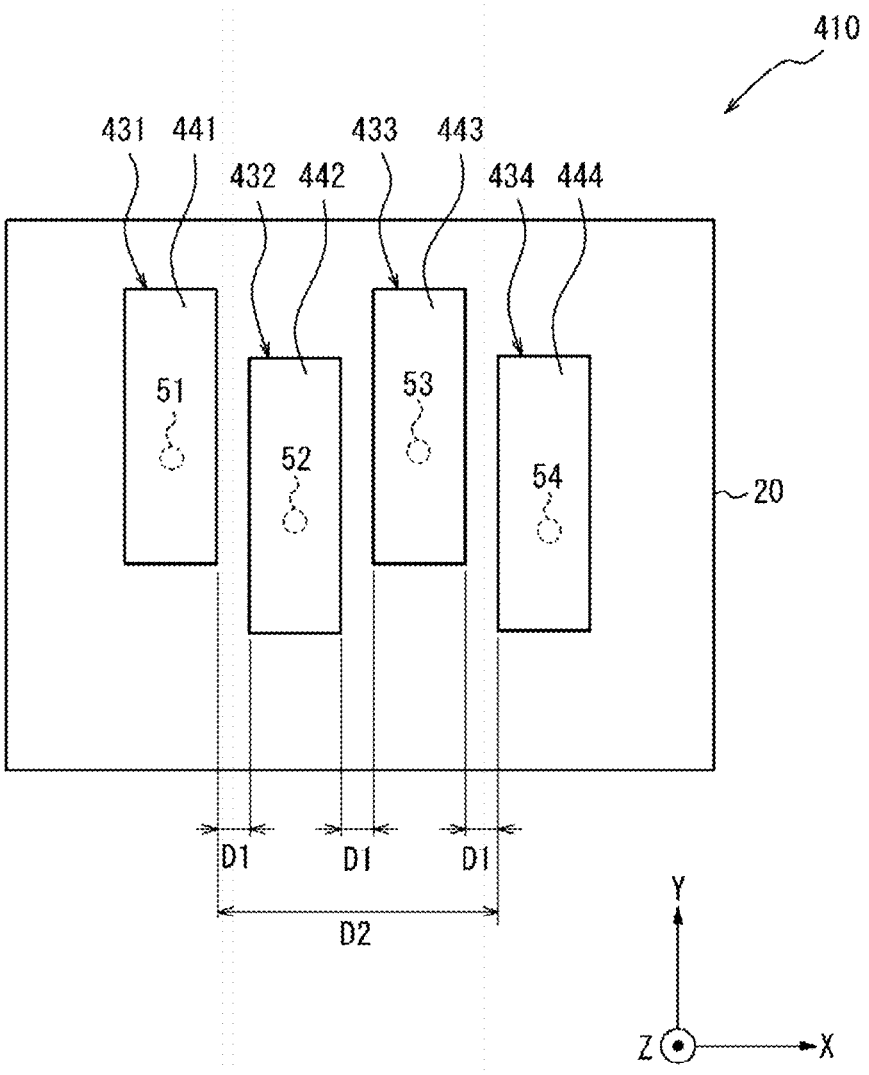
FIG. 16 is a plan view of an antenna according to an embodiment.

FIG. 16 is a plan view of an antenna 410 according to an embodiment. In FIG. 16, a first direction is the X direction. A second direction is the Y direction. However, the first direction and the second direction do not have to be orthogonal to each other. The first direction and the second direction may intersect.

The antenna 410 can be an array antenna. The antenna 410 may be a linear array antenna.

The antenna 410 has the base 20 and n (n: 3 or more integers) antenna elements as a plurality of antenna elements. In the present embodiment, the antenna 410 has four antenna elements (n=4), that is, a first antenna element 431, a second antenna element 432, a third antenna element 433, and a fourth antenna element 434.

The antenna 410 may appropriately have the first coupler 70 illustrated in FIG. 1, the second coupler 73 illustrated in FIG. 1, and the third coupler 74 and the fourth coupler 75 illustrated in FIG. 11, depending on the configuration of the first antenna element 431 and the like.

The first antenna element 431 may be the first antenna element 31 illustrated in FIG. 1 or the first antenna element 131 illustrated in FIG. 9. The first antenna element 431 has a first radiation conductor 441 and the first feeder line 51. The first radiation conductor 441 may have the same or similar configuration as the first radiation conductor 41 illustrated in FIG. 1.

The second antenna element 432 may be the second antenna element 32 illustrated in FIG. 1 or the second antenna element 132 illustrated in FIG. 9. The second antenna element 432 has a second radiation conductor 442 and the second feeder line 52. The second radiation conductor 442 may have the same or similar configuration as the second radiation conductor 42 illustrated in FIG. 1.

The third antenna element 433 is configured to resonate in a first frequency band or a second frequency band depending on the use of the antenna 410 and the like. The third antenna element 433 may have the same or similar configuration as the first antenna element 431 or the second antenna element 432. The third antenna element 433 has a third radiation conductor 443 and a third feeder line 53. The third radiation conductor 443 may have the same or similar configuration as the first radiation conductor 41 or the second radiation conductor 42 illustrated in FIG. 1. The third feeder line 53 may have the same or similar configuration as the first feeder line 51 or the second feeder line 52 illustrated in FIG. 3.

The fourth antenna element 434 is configured to resonate in a first frequency band or a second frequency band depending on the use of the antenna 410 and the like. The fourth antenna element 434 may have the same or similar configuration as the first antenna element 431 or the second antenna element 432. The fourth antenna element 434 has a fourth radiation conductor 444 and a fourth feeder line 54. The fourth radiation conductor 444 may have the same or similar configuration as the first radiation conductor 41 or the second radiation conductor 42 illustrated in FIG. 1. The fourth feeder line 54 may have the same or similar configuration as the first feeder line 51 or the second feeder line 52 illustrated in FIG. 3.

The first antenna element 431 to the fourth antenna element 434 may be configured to resonate in the same phase. The first feeder line 51 to the fourth feeder line 54 may be configured to feed signals that respectively excite the first antenna element 431 to the fourth antenna element 434 in the same phase. When exciting the first antenna element 431 to the fourth antenna element 434 in the same phase, the signals fed from the first feeder line 51 to the fourth feeder line 54 to the first antenna element 431 to the fourth antenna element 434 may have the same phase. When exciting the first antenna element 431 to the fourth antenna element 434 in the same phase, the signals fed from the first feeder line 51 to the fourth feeder line 54 to the first antenna element 431 to the fourth antenna element 434 may have different phases.

The first antenna element 431 to the fourth antenna element 434 may be configured to resonate in different phases. The first feeder line 51 to the fourth feeder line 54 may be configured to feed signals that respectively excite the first antenna element 431 to the fourth antenna element 434 in different phases. When exciting the first antenna element 431 to the fourth antenna element 434 in different phases, the signals fed from the first feeder line 51 to the fourth feeder line 54 to the first antenna element 431 to the fourth antenna element 434 may have the same phase. When exciting the first antenna element 431 to the fourth antenna element 434 in different phases, the signals fed from the first feeder line 51 to the fourth feeder line 54 to the first antenna element 431 to the fourth antenna element 434 may have different phases.

The first antenna element 431, the second antenna element 432, the third antenna element 433, and the fourth antenna element 434 are arranged along the X direction. The first antenna element 431, the second antenna element 432, the third antenna element 433, and the fourth antenna element 434 may be arranged at intervals equal to or less than ¼ of the resonance wavelength of the antenna 410 in the X direction. In the present embodiment, the first radiation conductor 441, the second radiation conductor 442, the third radiation conductor 443, and the fourth radiation conductor 444 are arranged along the X direction with an interval D1. The interval D1 is equal to or less than ¼ of the resonance wavelength of the antenna 410.

In a configuration in which the fourth antenna element 434 serving as an n-th antenna element resonates at the first frequency, the fourth radiation conductor 444 serving as an n-th radiation conductor may be arranged with the first radiation conductor 441 in the X direction at an interval equal to or less than ½ of the resonance wavelength of the antenna 410. In the present embodiment, the first radiation conductor 441 and the fourth radiation conductor 444 are arranged along the X direction with an interval D2. The interval D2 is equal to or less than ½ of the resonance wavelength of the antenna 410. The fourth radiation conductor 444 may be configured to be directly or indirectly coupled to the second radiation conductor 442.

The first antenna element 431 and the second antenna element 432 that are adjacent to each other may be shift in the Y direction. When the first antenna element 431 and the second antenna element 432 that are adjacent to each other are shift in the Y direction, the antenna 410 may have the first coupler 70 illustrated in FIG. 1, which is appropriately adjusted according to the shift. In the same or similar manner, the second antenna element 432 and the third antenna element 433 that are adjacent to each other, and the third antenna element 433 and the fourth antenna element 434 that are adjacent to each other may be shift in the Y direction. The antenna 410 may have the first coupler 70 that is appropriately adjusted according to the amount of shift between them.

Figure 17:
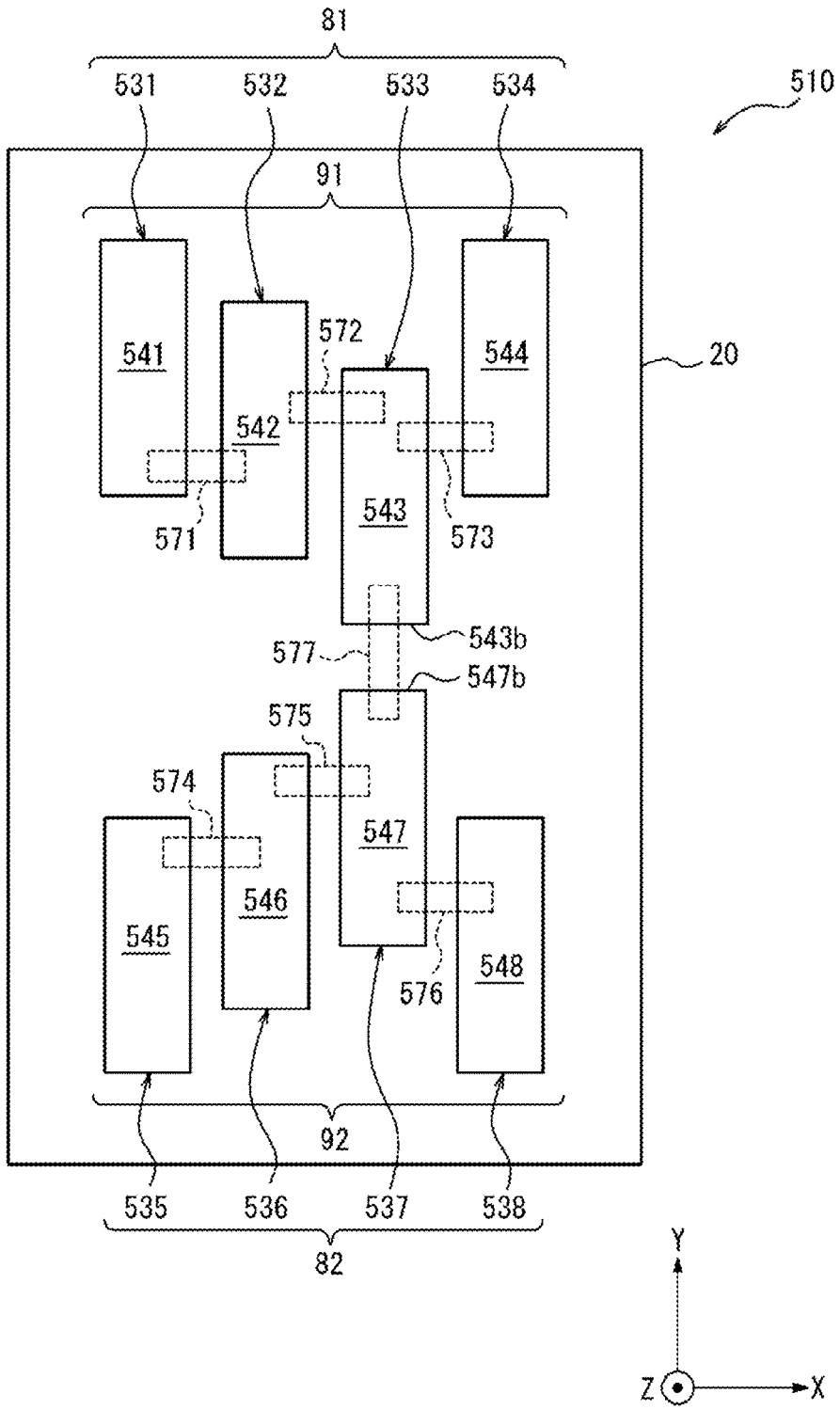
FIG. 17 is a plan view of an antenna according to an embodiment.

FIG. 17 is a plan view of an antenna 510 according to an embodiment. In FIG. 17, a first direction is the X direction. A second direction is the Y direction.

The antenna 510 can be an array antenna. The antenna 510 may be a planar array antenna.

The antenna 510 has the base 20, a first antenna element group 81, and a second antenna element group 82. The antenna 510 may further include second couplers 571, 572, 573, 574, 575, 576, and 577. The antenna 510 may appropriately include the first coupler 70 illustrated in FIG. 1, and the third coupler 74 and the fourth coupler 75 illustrated in FIG. 11, depending on the configuration of the first antenna element group 81 and the like.

Each of the first antenna element group 81 and the second antenna element group 82 extends along the X direction. The first antenna element group 81 and the second antenna element group 82 are arranged along the Y direction. Each of the first antenna element group 81 and the second antenna element group 82 may have the same or similar configuration as an antenna element group illustrated in FIG. 16. The antenna element group illustrated in FIG. 16 includes the first antenna element 431, the second antenna element 432, the third antenna element 433, and the fourth antenna element 434.

The first antenna element group 81 includes antenna elements 531, 532, 533, and 534. Each of the antenna elements 531 to 543 may have the same or similar configuration as the first antenna element 31 illustrated in FIG. 1, the second antenna element 32 illustrated in FIG. 1, the first antenna element 131 illustrated in FIG. 9, or the second antenna element 132 illustrated in FIG. 9. The antenna elements 531, 532, 533, and 534 include radiation conductors 541, 542, 543, and 544, respectively. Each of the radiation conductors 541 to 544 may have the same or similar configuration as the first radiation conductor 41 or the second radiation conductor 42 illustrated in FIG. 1.

The second antenna element group 82 includes antenna elements 535, 536, 537, and 538. Each of the antenna elements 535 to 538 may have the same or similar configuration as the first antenna element 31 illustrated in FIG. 1, the second antenna element 32 illustrated in FIG. 1, the first antenna element 131 illustrated in FIG. 9, or the second antenna element 132 illustrated in FIG. 9. The antenna elements 535, 536, 537, and 538 include radiation conductors 545, 546, 547, and 548, respectively. Each of the radiation conductors 545 to 548 may have the same or similar configuration as the first radiation conductor 41 or the second radiation conductor 42 illustrated in FIG. 1.

The antenna elements 531 to 538 may be configured to resonate in the same phase. Feeder lines of the antenna elements 531 to 538 may be configured to feed signals that excite the antenna elements 531 to 538 in the same phase. When the antenna elements 531 to 538 are excited in the same phase, the signals fed from the feeder lines of the antenna elements 531 to 538 to the antenna elements 531 to 538 may have the same phase. When the antenna elements 531 to 538 are excited in the same phase, the signals fed from the feeder lines of the antenna elements 531 to 538 to the antenna elements 531 to 538 may have different phases.

The antenna elements 531 to 538 may be configured to resonate in different phases. The feeder lines of the antenna elements 531 to 538 may be configured to feed the signals that excite the antenna elements 531 to 538 in different phases. When the antenna elements 531 to 538 are excited in different phases, the signals fed from the feeder lines of the antenna elements 531 to 538 to the antenna elements 531 to 538 may have the same phase. When the antenna elements 531 to 538 are excited in different phases, the signals fed from the feeder lines of the antenna elements 531 to 538 to the antenna elements 531 to 538 may have different phases.

In the first antenna element group 81, the antenna elements 531 to 534 are arranged along the X direction. The antenna elements 531 to 534 may be arranged to be shifted in the Y direction. Of the antenna elements 531 to 534, the antenna element 533 protrudes toward the second antenna element group 82.

In the second antenna element group 82, the antenna elements 535 to 538 are arranged along the X direction. The antenna elements 535 to 538 may be arranged to be shifted in the Y direction. Of the antenna elements 535 to 538, the antenna element 537 protrudes toward the first antenna element group 81.

At least one antenna element of the first antenna element group 81 is configured to be coupled to at least one antenna element of the second antenna element group 82 with the first coupling method or the second coupling method. In the present embodiment, the radiation conductor 543 of the antenna element 533 of the first antenna element group 81 is configured to be coupled to the radiation conductor 547 of the antenna element 537 of the second antenna element group 82 with the second coupling method in which the capacitance coupling is dominant. For example, a short side 543*b* of the radiation conductor 543 and a short side 547*b* of the radiation conductor 547 face each other. The short side 543*b* and the short side 547*b* facing each other can configure a capacitor via the base 20. By configuring the capacitor, the radiation conductor 543 of the antenna element 533 is configured to be coupled to the radiation conductor 547 of the antenna element 537 with the second coupling method in which the capacitive coupling is dominant.

The first antenna element group 81 includes the radiation conductors 541, 542, 543, and 544 as a first radiation conductor group 91. The second antenna element group 82 includes the radiation conductors 545, 546, 547, and 548 as a second radiation conductor group 92.

In the first radiation conductor group 91, the radiation conductor 541 and the radiation conductor 542 that are adjacent to each other are configured to be coupled with the first coupling method in which the magnetic field coupling is dominant, in the same as or similar to the first radiation conductor 41 and the second radiation conductor 42 illustrated in FIG. 1. The radiation conductor 542 and the radiation conductor 543 that are adjacent to each other are configured to be coupled with the first coupling method in which the magnetic field coupling is dominant. The radiation conductor 543 and the radiation conductor 544 that are adjacent to each other are configured to be coupled with the first coupling method in which the magnetic field coupling is dominant.

In the second radiation conductor group 92, the radiation conductor 545 and the radiation conductor 546 that are adjacent to each other are configured to be coupled with the first coupling method in which the magnetic field coupling is dominant, in the same as or similar to the first radiation conductor 41 and the second radiation conductor 42 illustrated in FIG. 1. The radiation conductor 546 and the radiation conductor 547 that are adjacent to each other are configured to be coupled with the first coupling method in which the magnetic field coupling is dominant. The radiation conductor 547 and the radiation conductor 548 that are adjacent to each other are configured to be coupled with the first coupling method in which the magnetic field coupling is dominant.

The second coupler 571 is configured to couple the radiation conductor 541 and the radiation conductor 542 that are adjacent to each other with the second coupling method in which the capacitive coupling is dominant, in the same as or similar to the second coupler 73 illustrated in FIG. 5. Since the second coupler 571 couples the radiation conductor 541 and the radiation conductor 542 that are adjacent to each other with the second coupling method, the mutual coupling between the radiation conductor 541 and the radiation conductor 542 that are adjacent to each other can be reduced.

In the same as or similar to the second coupler 571, the second coupler 572 is configured to couple the radiation conductor 542 and the radiation conductor 543 that are adjacent to each other with the second coupling method in which the capacitive coupling is dominant. The second coupler 573 is configured to couple the radiation conductor 543 and the radiation conductor 544 that are adjacent to each other with the second coupling method in which the capacitive coupling is dominant. The second coupler 574 is configured to couple the radiation conductor 545 and the radiation conductor 546 that are adjacent to each other with the second coupling method in which the capacitive coupling is dominant. The second coupler 575 is configured to couple the radiation conductor 546 and the radiation conductor 547 that are adjacent to each other with the second coupling method in which the capacitive coupling is dominant. The second coupler 576 is configured to couple the radiation conductor 547 and the radiation conductor 548 that are adjacent to each other with the second coupling method in which the capacitive coupling is dominant. Such a configuration can reduce the mutual coupling between adjacent radiation conductors.

The second coupler 577 is configured to magnetically couple the radiation conductor 543 of the first radiation conductor group 91 and the radiation conductor 547 of the second radiation conductor group 92. The second coupler 577 may include a coil or the like.

Since the second coupler 577 magnetically couples the radiation conductor 543 and the radiation conductor 547, the mutual coupling between the radiation conductor 543 and the radiation conductor 547 can be reduced.

Figure 18:
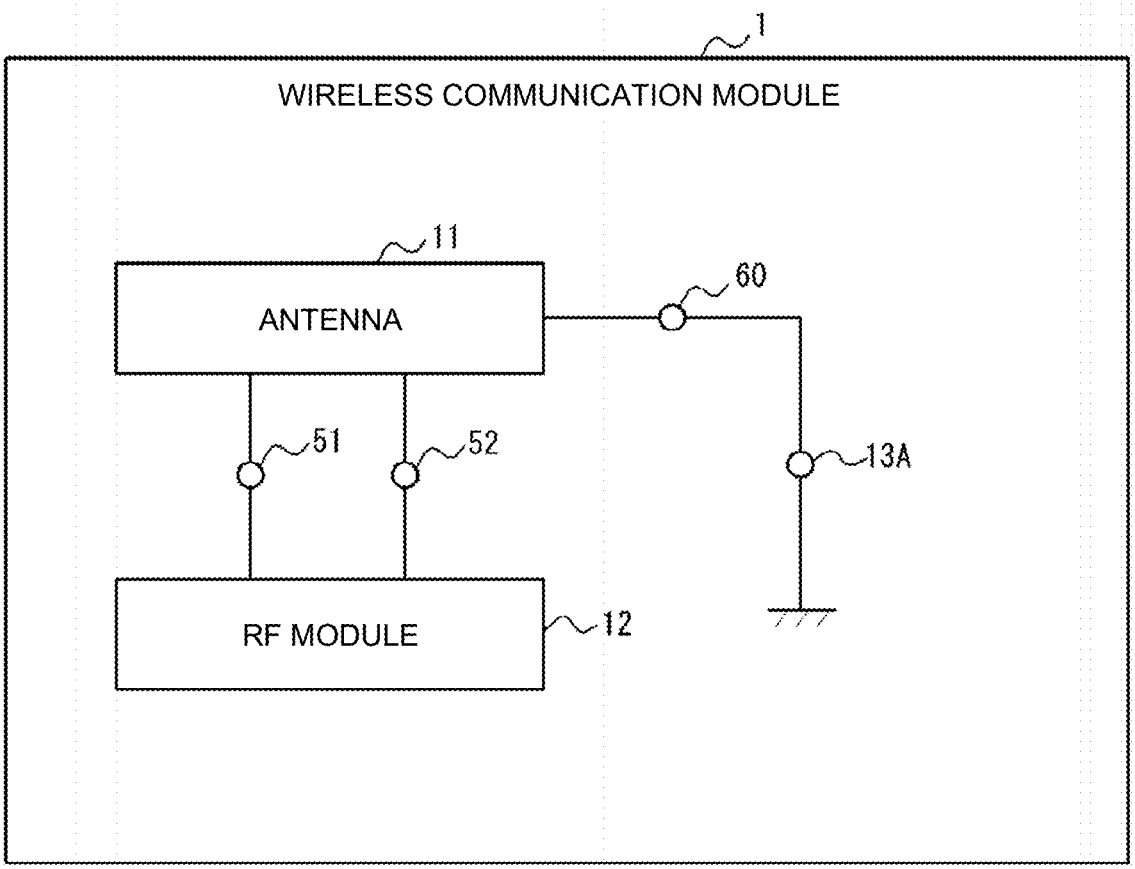
FIG. 18 is a block diagram of a wireless communication module according to an embodiment.
Figure 19:
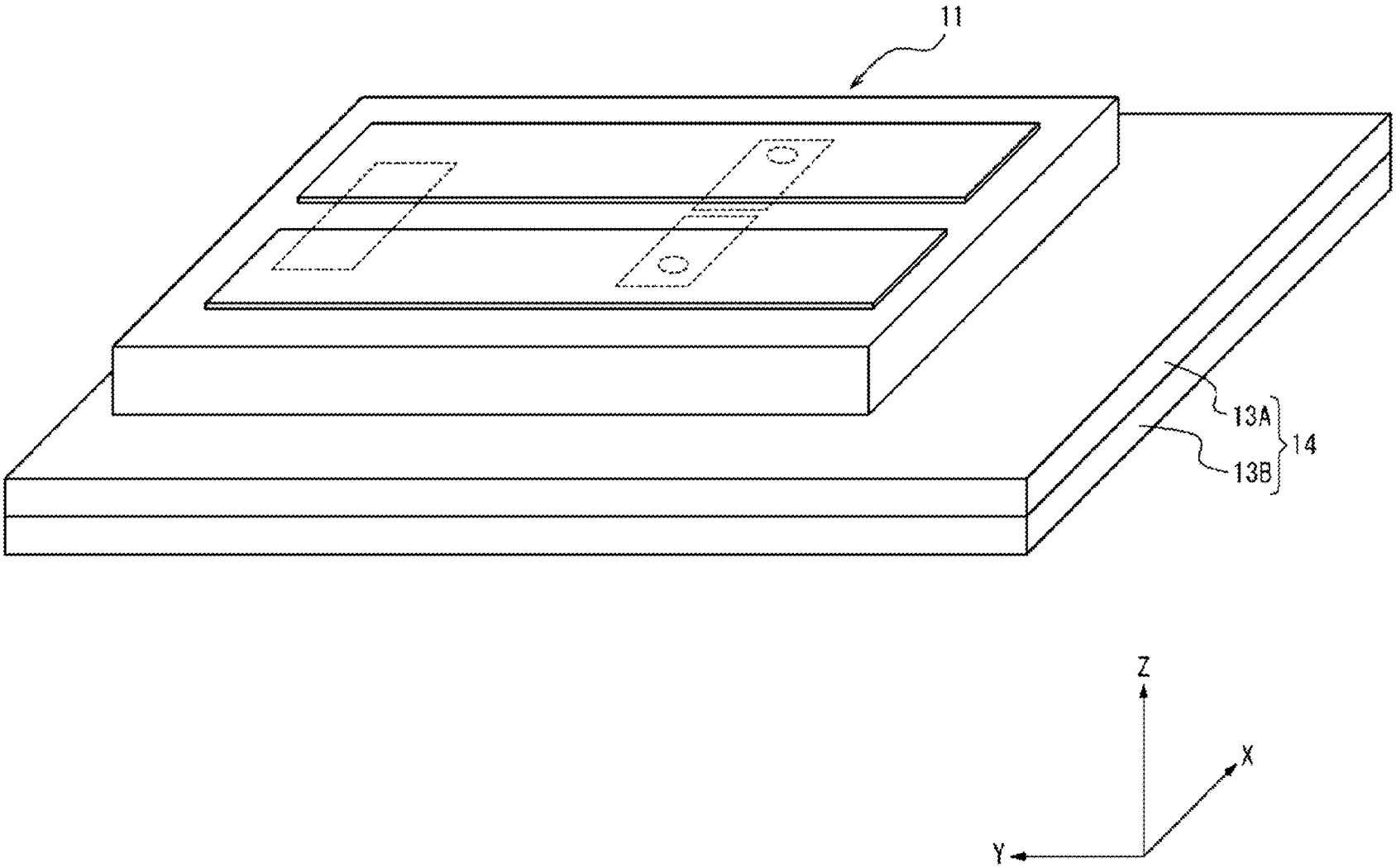
FIG. 19 is a schematic configuration view of the wireless communication module illustrated in FIG. 18.

FIG. 18 is a block diagram of a wireless communication module 1 according to an embodiment. FIG. 19 is a schematic configuration view of the wireless communication module 1 illustrated in FIG. 18.

The wireless communication module 1 includes an antenna 11, an RF module 12, and a circuit board 14. The circuit board 14 has a ground conductor 13A and a printed circuit board 13B.

The antenna 11 includes the antenna 10 illustrated in FIG. 1. However, instead of the antenna 10 illustrated in FIG. 1, the antenna 11 may include any of the antenna 110 illustrated in FIG. 9, the antenna 210 illustrated in FIG. 11, the antenna 310 illustrated in FIG. 15, the antenna 410 illustrated in FIG. 16, and the antenna 510 illustrated in FIG. 17. The antenna 11 has the first feeder line 51 and the second feeder line 52. The antenna 11 has a ground conductor 60. The ground conductor 60 is configured by integrating the first ground conductor 61 and the second ground conductor 62 illustrated in FIG. 2.

The antenna 11 is located on the circuit board 14 as illustrated in FIG. 19. The first feeder line 51 of the antenna 11 is configured to be connected to the RF module 12 illustrated in FIG. 18 via the circuit board 14 illustrated in FIG. 19. The second feeder line 52 of the antenna 11 is configured to be connected to the RF module 12 illustrated in FIG. 18 via the circuit board 14 illustrated in FIG. 19. The ground conductor 60 of the antenna 11 is configured to be electromagnetically connected to the ground conductor 13A included in the circuit board 14.

The antenna 11 is not limited to the one having both the first feeder line 51 and the second feeder line 52. The antenna 11 may have one feeder line of the first feeder line 51 and the second feeder line 52. When the antenna 11 has one feeder line of the first feeder line 51 and the second feeder line 52, the configuration of the circuit board 14 can be appropriately changed according to the configuration of the antenna 11 having one feeder line. For example, the RF module 12 may have only one connection terminal. For example, the circuit board 14 may have one conductive wire configured to connect the connection terminal of the RF module 12 and the feeder line of the antenna 11.

The ground conductor 13A may include a conductive material. The ground conductor 13A can extend in the XY plane.

The antenna 11 may be integrated with the circuit board 14. In the configuration in which the antenna 11 and the circuit board 14 are integrated, the ground conductor 60 of the antenna 11 may be integrated with the ground conductor 13A of the circuit board 14.

The RF module 12 is configured to control power fed to the antenna 11. The RF module 12 is configured to modulate a baseband signal and supply the modulated baseband signal to the antenna 11. The RF module 12 is configured to modulate an electrical signal received by the antenna 11 into the baseband signal.

The wireless communication module 1 can efficiently radiate electromagnetic waves by including the antenna 11.

Figure 20:
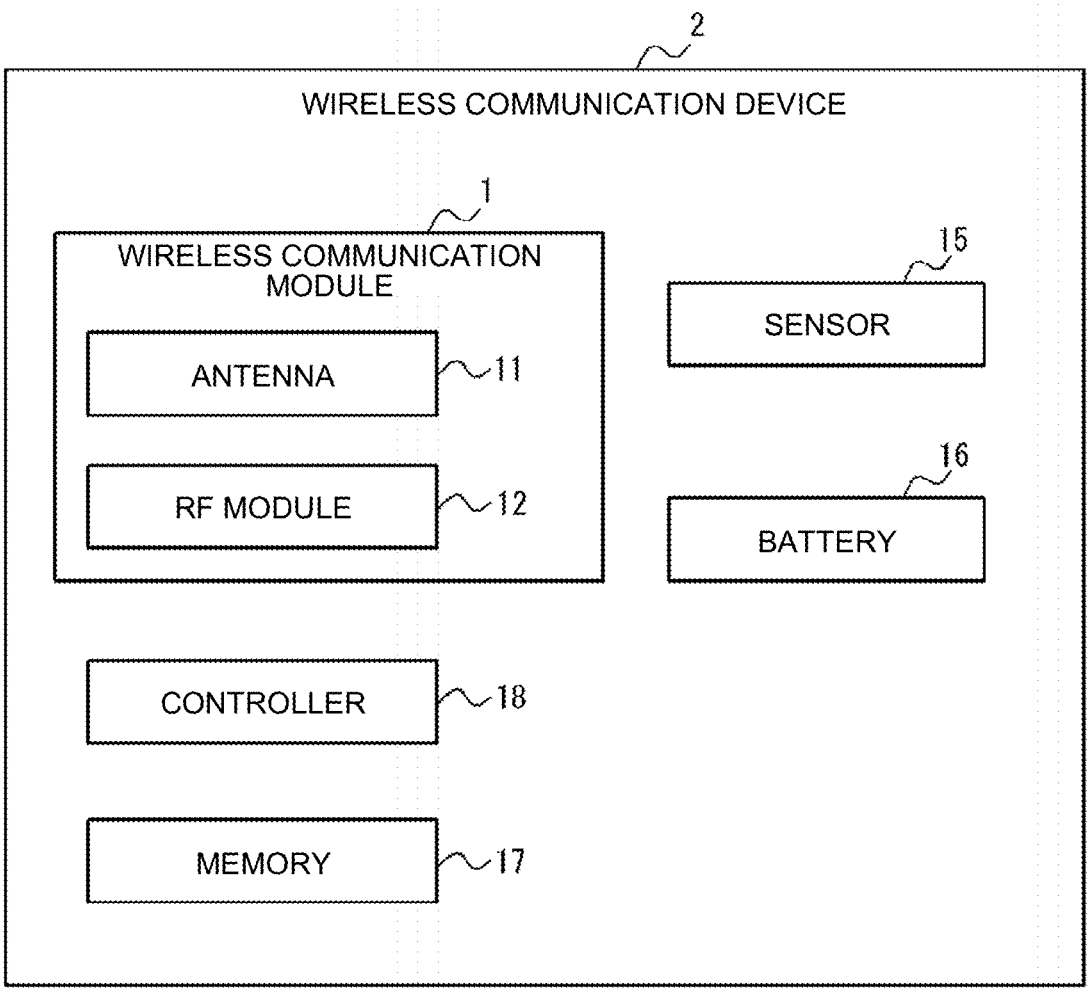
FIG. 20 is a block diagram of a wireless communication device according to an embodiment.
Figure 21:
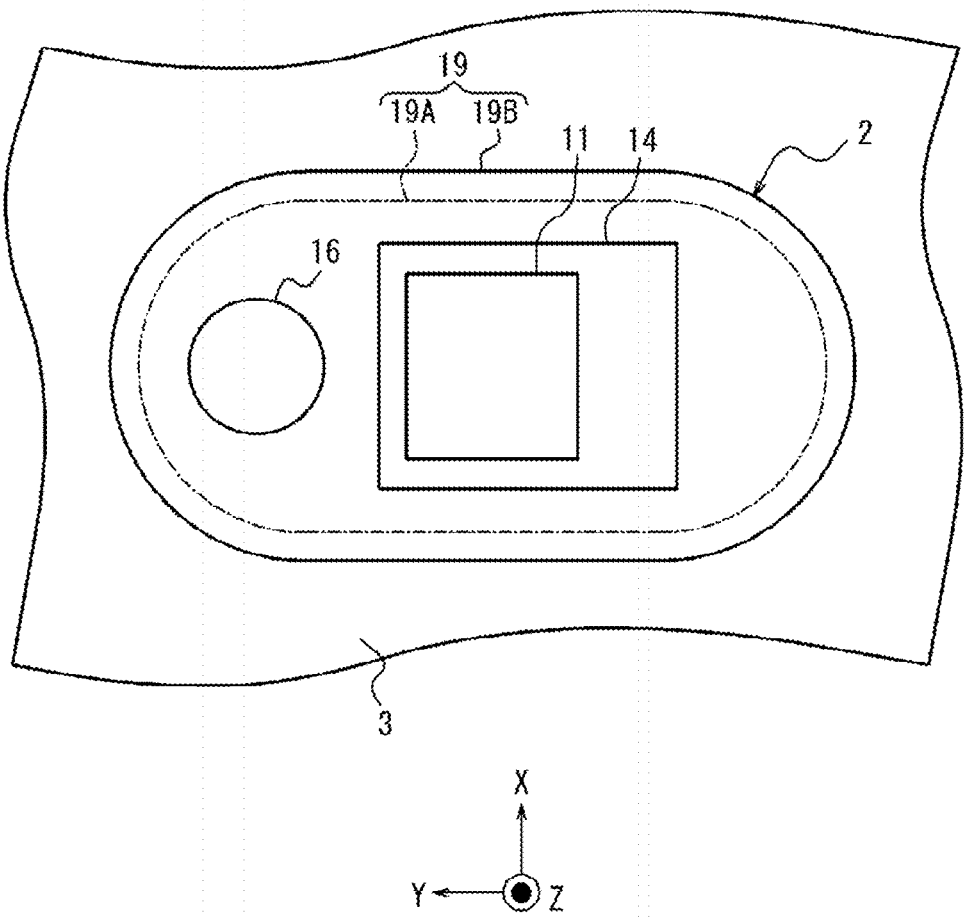
FIG. 21 is a plan view of the wireless communication device illustrated in FIG. 20.
Figure 22:
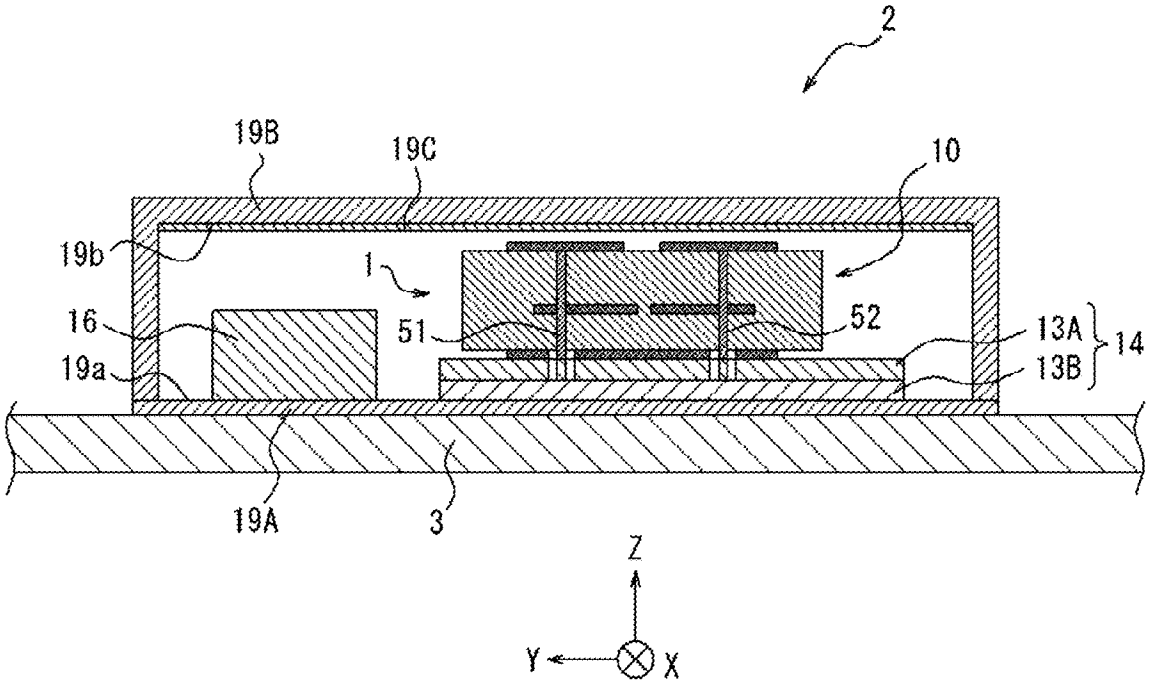
FIG. 22 is a cross-sectional view of the wireless communication device illustrated in FIG. 20.

FIG. 20 is a block diagram of a wireless communication device 2 according to an embodiment. FIG. 21 is a plan view of the wireless communication device 2 illustrated in FIG. 20. FIG. 22 is a cross-sectional view of the wireless communication device 2 illustrated in FIG. 20.

The wireless communication device 2 can be located on a board 3. A material of the board 3 may be any material. As illustrated in FIG. 20, the wireless communication device 2 includes the wireless communication module 1, a sensor 15, a battery 16, a memory 17, and a controller 18. As illustrated in FIG. 21, the wireless communication device 2 includes a housing 19.

The sensor 15 may include, for example, a speed sensor, a vibration sensor, an acceleration sensor, a gyro sensor, a rotation angle sensor, an angular velocity sensor, a geomagnetic sensor, a magnet sensor, a temperature sensor, a humidity sensor, an atmospheric pressure sensor, an optical sensor, an illuminance sensor, a UV sensor, a gas sensor, a gas concentration sensor, an atmosphere sensor, a level sensor, an odor sensor, a pressure sensor, an air pressure sensor, a contact sensor, a wind power sensor, an infrared sensor, a human sensor, a displacement sensor, an image sensor, a weight sensor, a smoke sensor, a liquid leakage sensor, a vital sensor, a battery remaining amount sensor, an ultrasonic sensor, or a global positioning system (GPS) signal receiving device, or the like.

The battery 16 is configured to supply power to the wireless communication module 1. The battery 16 may be configured to supply the power to at least one of the sensor 15, the memory 17, and the controller 18. The battery 16 may include at least one of a primary battery and a secondary battery. A negative electrode of the battery 16 is configured to be electrically connected to the ground terminal of the circuit board 14 illustrated in FIG. 19. The negative electrode of the battery 16 is configured to be electrically connected to the ground conductor 60 of the antenna 11.

The memory 17 can include, for example, a semiconductor memory or the like. The memory 17 may be configured to function as a work memory of the controller 18. The memory 17 can be included in the controller 18. The memory 17 stores a program that describes processing contents for implementing each function of the wireless communication device 2, information used for processing in the wireless communication device 2, and the like.

The controller 18 can include, for example, a processor. The controller 18 may include one or more processors. The processor may include a general-purpose processor that loads a specific program and executes a specific function, and a dedicated processor that is specialized for specific processing. The dedicated processor may include an application specific IC. The application specific IC is also called an application specific integrated circuit (ASIC). The processor may include a programmable logic device. The programmable logic device is also called a programmable logic device (PLD). The PLD may include a field-programmable gate array (FPGA). The controller 18 may be either a system-on-a-chip (SoC) in which one or a plurality of processors cooperate, and a system in a package (SiP). The controller 18 may store various kinds of information, a program for operating each component of the wireless communication device 2, or the like in the memory 17.

The controller 18 is configured to generate a transmission signal transmitted from the wireless communication device 2. The controller 18 may be configured to acquire measurement data from, for example, the sensor 15. The controller 18 may be configured to generate a transmission signal according to the measurement data. The controller 18 can be configured to transmit a baseband signal to the RF module 12 of the wireless communication module 1.

The housing 19 illustrated in FIG. 21 is configured to protect other devices of the wireless communication device 2. The housing 19 may include a first housing 19A and a second housing 19B.

The first housing 19A illustrated in FIG. 22 can extend in the XY plane. The first housing 19A is configured to support other devices. The first housing 19A may be configured to support the wireless communication device 2. The wireless communication device 2 is located on an upper surface 19*a* of the first housing 19A. The first housing 19A may be configured to support the battery 16. The battery 16 is located on the upper surface 19*a* of the first housing 19A.

The wireless communication module 1 and the battery 16 may be arranged along the X direction on the upper surface 19*a* of the first housing 19A.

The second housing 19B illustrated in FIG. 22 may be configured to cover other devices. The second housing 19B includes a lower surface 19*b* located on the negative direction side of the Z axis of the antenna 11. The lower surface 19*b* extends along the XY plane. The lower surface 19*b* is not limited to being flat and can include irregularities. The second housing 19B may have a conductor member 19C. The conductor member 19C is located on at least one of the interior, the outside, and the inside of the second housing 19B. The conductor member 19C is located on at least one of the upper surface and the side surface of the second housing 19B.

The conductor member 19C illustrated in FIG. 22 faces the antenna 11. The antenna 11 can be coupled to the conductor member 19C to radiate the electromagnetic waves by using the conductor member 19C as a secondary radiator. When the antenna 11 and the conductor member 19C face each other, the capacitive coupling between the antenna 11 and the conductor member 19C can be increased. When a current direction of the antenna 11 is along the extending direction of the conductor member 19C, the electromagnetic coupling between the antenna 11 and the conductor member 19C can be increased. This coupling can be a mutual inductance.

The configuration according to the present disclosure is not limited to the embodiments described above, and various modifications or changes can be made. For example, the functions and the like included in each component can be rearranged so as not to logically contradict each other, and a plurality of components can be combined into one or divided.

For example, in the above-described embodiments as illustrated in FIG. 5, the second coupler 73 is described as being located on the negative direction side of the Z axis as compared to the first radiation conductor 41 and the second radiation conductor 42. However, the second coupler 73 does not have to be located on the negative direction side of the Z axis if it is configured to couple the first radiation conductor 41 and the second radiation conductor 42 with the second coupling method.

For example, the second coupler 73 may be located on the positive direction side of the Z axis as compared to the first radiation conductor 41 and the second radiation conductor 42.

The diagrams illustrating the configuration according to the present disclosure are schematic. The dimensional ratios and the like on the drawings do not always match the actual ones.

In the present disclosure, the terms "first", "second", "third" and so on are examples of identifiers meant to distinguish the configurations from each other. In the present disclosure, regarding the configurations distinguished by the terms "first" and "second", the respective identifying numbers can be reciprocally exchanged. For example, regarding a first frequency and a second frequency, the identifiers "first" and "second" can be reciprocally exchanged. The exchange of identifiers is performed simultaneously. Even after exchanging the identifiers, the configurations remain distinguished from each other. Identifiers may be removed. The configurations from which the identifiers are removed are still distinguishable by the reference numerals. In the present disclosure, the terms "first", "second", and so on of the identifiers should not be used in the interpretation of the order of the configurations, or should not be used as the basis for having identifiers with low numbers, or should not be used as the basis for having identifies with high numbers.

The invention claimed is:

1. An antenna comprising:

a first antenna element that includes a first radiation conductor and a first feeder line and is configured to resonate in a first frequency band;

a second antenna element that includes a second radiation conductor and a second feeder line and is configured to resonate in a second frequency band;

a first coupler; and a second coupler, wherein the second feeder line is configured to be coupled to the first feeder line such that a first component is dominant, the first component being one of a capacitance component and an inductance component, the first coupler is configured to couple the first feeder line and the second feeder line such that a second component different from the first component is dominant, the first radiation conductor and the second radiation conductor are arranged at an interval equal to or less than ½ of a resonance wavelength of the antenna, the second radiation conductor is configured to be coupled to the first radiation conductor with a first coupling method in which one of a capacitive coupling and a magnetic field coupling is dominant, and the second coupler is configured to couple the first radiation conductor and the second radiation conductor with a second coupling method different from the first coupling method.

2. The antenna according to claim 1, wherein the first frequency band and the second frequency band belong to a same frequency band.

3. The antenna according to claim 1, wherein the first frequency band and the second frequency band belong to different frequency bands.

4. The antenna according to claim 1, wherein the first antenna element further includes a first ground conductor.

5. The antenna according to claim 4, wherein the second antenna element further includes a second ground conductor.

6. The antenna according to claim 5, wherein the first ground conductor is connected to the second ground conductor.

7. The antenna according to claim 5, wherein the first ground conductor and the second ground conductor are formed integrally, and the first ground conductor and the second ground conductor are integrated with a single base.

8. The antenna according to claim 1, further comprising a third coupler configured to couple the first radiation conductor and the second feeder line.

9. The antenna according to claim 8, wherein the third coupler is configured to couple the first radiation conductor and the second feeder line such that the second component is dominant.

10. The antenna according to claim 1, further comprising a fourth coupler configured to couple the second radiation conductor and the first feeder line.

11. The antenna according to claim 10, wherein the fourth coupler is configured to couple the second radiation conductor and the first feeder line such that the second component is dominant.

12. The antenna according to claim 1, further comprising a plurality of antenna elements including the first antenna element and the second antenna element, wherein the plurality of antenna elements are arranged along a first direction, and adjacent antenna elements included in the plurality of antenna elements are shift in a second direction different from the first direction.

13. The antenna according to claim 12, wherein the plurality of antenna elements are arranged in the first direction at intervals equal to or less than ¼ of the resonance wavelength.

14. The antenna according to claim 12, wherein the plurality of antenna elements include an n-th antenna element that includes an n-th radiation conductor and an n-th feeder line and is configured to resonate in the first frequency band, n being an integer of 3 or more, and the n-th radiation conductor is arranged with the first radiation conductor in the first direction at an interval equal to or less than ½ of the resonance wavelength.

15. The antenna according to claim 14, wherein the n-th radiation conductor is configured to be directly or indirectly coupled to the second radiation conductor.

16. The antenna according to claim 12, wherein the plurality of antenna elements includes a first antenna element group arranged in the first direction, and a second antenna element group arranged in the first direction, and at least one antenna element of the first antenna element group is configured to be coupled to at least one antenna element of the second antenna element group with the first coupling method or the second coupling method.

17. The antenna according to claim 16, wherein the first antenna element group includes a first radiation conductor group, the second antenna element group includes a second radiation conductor group, adjacent radiation conductors included in the first radiation conductor group are configured to be coupled with the first coupling method, and the second coupler is configured to couple the adjacent radiation conductors included in the first radiation conductor group with the second coupling method, and magnetically couple a radiation conductor included in the first radiation conductor group and a radiation conductor included in the second radiation conductor group.

18. The antenna according to claim 17, wherein the adjacent radiation conductors included in the second radiation conductor group are configured to be coupled with the first coupling method, and the second coupler is configured to couple the adjacent radiation conductors included in the second radiation conductor with the second coupling method.

19. A wireless communication module comprising:

the antenna according to claim 1; and an RF module configured to be electrically connected to at least one of the first feeder line and the second feeder line.

20. A wireless communication device comprising:

the wireless communication module according to claim 19; and a battery configured to supply power to the wireless communication module.

* * * * *